United States Patent [19]

Maxwell et al.

[11] 4,271,757

[45] Jun. 9, 1981

[54] ROTARY OFFSET ARTICLE PRINTING SYSTEM

[75] Inventors: William E. Maxwell, Keene; Peter Jenness, III, Spofford; Michael F. Potter, Keene, all of N.H.

[73] Assignee: Markem Corporation, Keene, N.H.

[21] Appl. No.: 40,301

[22] Filed: May 18, 1979

[51] Int. Cl.[3] ..... B41F 17/00

[52] U.S. Cl. ..... 101/37; 101/181; 101/248

[58] Field of Search ..... 101/35–36, 101/37, 172, 234, 235, 181, 182, 228, 248, 116

[56] References Cited

U.S. PATENT DOCUMENTS

| | | | |
|---|---|---|---|
| 2,761,545 | 9/1956 | Hoagland | 101/37 X |
| 3,049,078 | 8/1962 | Smith | 101/228 |
| 3,092,019 | 6/1963 | Van Buskirk | 101/35 |
| 3,198,114 | 8/1965 | Jones et al. | 101/248 X |
| 3,200,742 | 8/1965 | Kasermann | 101/247 |
| 3,238,869 | 3/1966 | West et al. | 101/228 |
| 3,264,983 | 8/1966 | Lewis et al. | 101/248 X |
| 3,294,015 | 12/1966 | Gartside | 101/35 |
| 3,306,190 | 2/1967 | Groth | 101/37 |
| 3,394,651 | 7/1968 | Ochs | 101/35 |
| 3,611,920 | 10/1971 | Timko | 101/35 |
| 3,732,815 | 5/1973 | Greiner et al. | 101/220 |
| 3,738,260 | 6/1973 | Navi et al. | 101/35 |
| 3,752,067 | 8/1973 | Gill | 101/37 |
| 3,869,983 | 3/1975 | Garber et al. | 101/137 |
| 3,889,595 | 6/1975 | Jaffa | 101/116 |
| 3,921,519 | 11/1975 | Zimner | 101/116 |
| 4,109,574 | 8/1978 | Forster et al. | 101/216 |

OTHER PUBLICATIONS

Markham Corporation Literature Model 244 Printer, #0871290 Roll.

*Primary Examiner*—Edward M. Coven
*Attorney, Agent, or Firm*—Irons & Sears

[57] ABSTRACT

An article printing system is disclosed wherein successive strips of closely-spaced interconnected articles, such as electronic components, are fed in an intermittent manner by an endless conveyor belt to a printing nip located beneath a continuously rotating offset roll which is arranged for synchronized vertical reciprocation. Belt perforations corresponding in location to each individual article to be printed are sensed by a photoelectric detector to stop the article at a ready position located a predetermined distance from the printing nip. When a printed image on the offset roll rotates to a position of predicted registration with the motionless article surface below, the belt is restarted and the offset roll is lowered to its printing position in order to transfer the image to the article as it traverses the printing nip. After the image has been transferred, the offset roll is restored to its upper retracted position to avoid premature frictional contact with the leading edge of the next article to be printed. The belt continues to move until detection of the next perforation stops the belt in preparation for another printing cycle. Additional pairs of perforations, distinguishable by their characteristic spacing from the perforations corresponding to individual articles, are sensed by a second photoelectric detector for stopping the system after an entire strip of articles has been printed in order to allow a new strip to be loaded onto the belt.

26 Claims, 29 Drawing Figures

ROTARY OFFSET ARTICLE PRINTING SYSTEM

BACKGROUND OF THE INVENTION

1. Field of the Invention

This invention relates to an intermittently-fed rotary offset printing system of particular utility in printing identifying indicia on small, closely spaced articles, such as electronic components.

2. Description of the Prior Art

Known rotary article printing systems are generally continuously fed, by which it is meant that the articles to be marked are conveyed to the printing station at a uniform rate of speed. Printing is usually accomplished by a uniformly rotating die wheel or printing drum which makes rolling contact with the moving articles. Under these conditions, the delivery speed of the articles and the circumferential speed of the printing drum must be closely matched in order for a clear printed image to be obtained. A system for accomplishing this result is described, for example, in U.S. Pat. No. 2,761,545, to W. L. Hoagland.

In some cases, although the articles are delivered to the printing station at a uniform speed by a conveyor belt or the like, the spacing between successive articles may bear no convenient relationship to the spacing of printing dies on the rotary printing element. This may occur, for example, when the articles are delivered to the printing station in a widely or randomly spaced manner. In these instances, it has been the practice to drive the rotary printing element intermittently, stopping it at a known prealignment position after each printing operation and then accelerating it to the article speed when the arrival of the next article at a predetermined point is detected. Article marking systems operating in this general manner are disclosed, for example, in U.S. Pat. No. 3,092,019, to J. D. Van Buskirk, 3,394,651, to C. S. Ochs, and 3,738,260, to M. Navi et al.

A further problem arises where the spacing between successive articles approaches the closest spacing available between printing dies on the periphery of the printing drum. Electrical components, for example, are often fabricated in continuous strips with less than an inch between centers. It is inconvenient to provide the printing drum with the numerous identical, closely spaced printing dies that would be required under such conditions in a continuously-fed system, particularly where the dies are frequently changed to accommodate different types of articles. Moreover, even this expedient is foreclosed when the spacing between articles in smaller than the closest available die spacing, this being so regardless of whether the printing drum rotates uniformly or intermittently.

The above described limitations may be avoided by driving the printing drum uniformly and feeding the articles to the printing station intermittently rather than continuously. The geometry of the printing drum then imposes no limitation on the minimum spacing between successive articles.

U.S. Pat. No. 3,198,114, to F. Jones et al., describes such a system in connection with a printer for a perforated ticket strip. In this system, the transverse lines of perforations defining individual tickets on the strip are sensed by a photoelectric detector in order to halt the feed mechanism at a predetermined point of alignment. The printing drum continues to rotate uniformly, however. This is possible since there is no engagement between the drum and ticket surface until the single set of projecting printing dies thereon rotate to a position of frictional contact with the ticket surface. The angular position of the printing drum is sensed by a cam and follower switch arrangement which subsequently restarts the feed mechanism as the printing dies on the drum are about to frictionally contact the surface to be printed. By equalizing the peripheral speed of the drum and the linear speed of the ticket strip after this point, printing may be made to occur at the desired location on the ticket surface. Operation of the feed mechanism continues until the photoelectric detector encounters a further line of perforations, at which point feeding is again halted in preparation for another printing operation. The necessary intermittent feeding operation of the disclosed printing system is accomplished by a solenoid-displaced feed roller, or alternatively by an electromagnetic clutch and brake apparatus.

Adjustment of the position of the printed image on the ticket surface is accomplished mechanically in the printing system disclosed in the Jones et al. patent. The initial alignment position at which the ticket strip is halted prior to printing, for example, is adjusted by manually displacing the photoelectric detector along the feed table. Similarly, the angular position of the printing drum at which ticket feeding is recommenced for printing is manually set by rotating the cam follower mounting plate about the drum shaft and then securing it in the desired position with clamping screws.

SUMMARY OF THE INVENTION

The present invention makes it possible to realize the advantages of intermittent feeding in a rotary offset printing system. In rotary offset systems, printed images are transferred to the surfaces to be printed through the intermediary of a smooth offset roll rather than directly by a die-bearing drum. Consequently, it is not possible to rely on the dimensions of projecting printing dies to provide the necessary clearance between the rotating printing member and the motionless article surface during the interval immediately prior to a printing operation, as taught by the prior art Jones et al. patent. The printing system of the present invention avoids this limitation.

In addition, the article positioning system employed in the printing system of the present invention does not require that the articles to be printed themselves include perforations or other special markings to trigger periodic interruption of the feeding operation. This is an important advantage when printing on small electronic components and the like, which frequently do not possess clearly defined apertures or other distinct markings that may be exploited for this purpose.

A further important feature of the present invention resides in the provision of electronic calibration circuitry and microprocessor control for enhancing the accuracy and consistency with which the printed indicia may be located on the surfaces of the articles to be printed. In addition, microprocessor control permits the mode of operation of the printing system to be changed without major hardware modifications merely by selecting among different microprogram sequences. Such flexibility is not readily realized in wholly mechanical or electromechanical article printing systems.

In accordance with the present invention, the articles to be printed, which may take the form of a strip of interconnected dual inline packages housing integrated semiconductor circuits, are carried by an endless conveyor belt having integral alignment pins for positively locating and propelling the articles. One edge of the belt is provided with a series of holes or perforations, referred to as print-stop perforations, whose location and spacing are indicative of the location and spacing of the articles carried by the belt. Although article spacing will generally be uniform, the printing system of the present invention will operate equally well with irregularly spaced articles.

Printing is accomplished by sequentially passing the articles on the endless belt beneath the printing nip of an offset roll which receives a wet image from a suitably inked printing die secured to an adjacent die roll. The offset wheel and die roll are made to rotate continuously and in synchronism. Further, in accordance with an important aspect of the present invention, the offset roll is arranged for synchronous vertical reciprocation into and out of contact with the surfaces of the articles to be printed by means of a vacuum-operated linear actuator or the like.

The article-carrying endless belt is intermittently driven. Photoelectric detection of each of the print-stop perforations along the edge of the belt halts its movement, and detection of a predetermined angular position of the offset roll subsequently restarts it. Sensing of the angular displacement of the offset wheel is accomplished indirectly by means of Hall effect switches arranged to detect the angular position of an iron vane secured to the shaft of the adjacent, synchronously rotating die roll.

A print cycle begins with the offset roll in its upper retracted position. An article to be printed is conveyed by the endless belt to a temporary rest or "ready" position located a predetermined distance before the printing nip. The arrival of the article at this point is indicated by the alignment of a corresponding print-stop perforation in the belt with a print station photoelectric detector positioned adjacent to the printing nip. At this point the motion of the belt is abruptly halted. The offset roll and die roll continue to rotate uniformly, however.

When the Hall effect angular position sensing apparatus cooperating with the die roll shaft indicates that a wet ink image on the synchronously rotating offset roll has reached a position of predicted registration with the waiting article surface below, the belt is restarted and the offset roll, which until this point has been maintained in its upper retracted position, is abruptly lowered by the linear actuator to the level of the article surface to be printed. As the offset roll surface rolls over the moving article, which has by now reached the printing position defined by the printing nip, the printed image thereon is smoothly transferred to the desired area on the article surface. The circumferential speed of the offset roll is closely matched to the linear speed of the article-carrying belt in order to insure that the image is transferred with no distortion.

After the image has been transferred, the offset roll is again raised to its retracted position in order to avoid the possibility of premature engagement with the leading edge of the next article to be printed or contact with the trailing edge of the article just printed. With the printing nip thus "broken", and the offset roll retracted, the belt continues to move until the alignment of the print station photoelectric detector with the next print-stop perforation on the endless belt indicates that the next article has reached the ready position just ahead of the printing nip, at which point the belt is halted in preparation for another printing cycle.

Since the articles upon which printing is to be carried out will typically comprise groups of small electronic components interconnected in strips of approximately ten components each, it is necessary for the printing system to discriminate between successive strips as well as between the individual components forming a single given strip. Accordingly, each strip-receiving location on the endless belt is preceded by a pair of additional holes or perforations, designated load-station perforations, which are spaced by a characteristic distance different from the spacing between the print-stop perforations in order to be readily distinguishable therefrom. A second photoelectric detector, referred to as the load station detector, is located near the article-loading end of the endless belt for the purpose of testing for the characteristic spacing of these additional perforations and bringing the printing system to a halt when the belt is in a position to receive a new strip from a loading device for printing.

In order to make possible the precise positional adjustments required when small, closely spaced articles such as electronic components are to be printed, the printing system of the present invention includes electronic circuitry for fine-tuning the relative timing of the operations comprising the print cycle described above. Fine adjustment of the point at which the endless belt is halted when an article approaches the printing nip (i.e., of the temporary rest or "ready" position) is made possible by a variable time delay device interposed in the print station photoelectric detector circuit, while coarse adjustments may be made by physically displacing the print station detector along the line of belt travel. Adjustable circuitry is also provided to establish the angular position of the die roll shaft which, through the intermediary of the Hall effect angular position sensing apparatus, will restart the belt and lower the offset wheel from its retracted position to its article printing position. This permits precise alignment of the printed images on the offset wheel with the article surfaces to which they will be applied. Further circuitry is provided to control the dwell time of the offset roll in its lowered or article-printing position, and to compensate for varying spacing of the printing dies around the circumference of the die roll.

All of the aforementioned electronic circuitry interfaces with an integrated microprocessor which is programmed for coordinating the stopping and starting of the endless belt and the up and down reciprocation of the offset roll in the proper time sequence. In the preferred embodiment of the inventive system, the versatility of microprocessor control is exploited by providing an optional program sequence whereby two or more articles may be printed during a single reciprocation cycle of the offset roll with only minimal hardware modifications (specifically, the attachment of additional printing dies to the die roll). In addition, the microprocessor is programmed to perform certain tests for determining whether printing is occurring normally, and to alert the operator in the event that further manual timing adjustments are required.

In the interest of precisely controlling the movement and positioning of the articles to be printed, the moving mass of the endless belt is kept to a minimum to reduce inertial startup lag and overshoot. In a preferred embodiment, the belt consists of a thin strip of stainless steel and the alignment pins are molded from a light plastic material. An oversized vacuum-actuated clutch and brake unit is used to accomplish the starting and stopping of the belt within the necessary tolerance.

BRIEF DESCRIPTION OF THE DRAWINGS

The advantages and novel features of the invention will be more fully apparent from the following detailed description when read with reference to the accompanying drawings, in which.

DESCRIPTION OF THE PREFERRED EMBODIMENT

Figure 1:
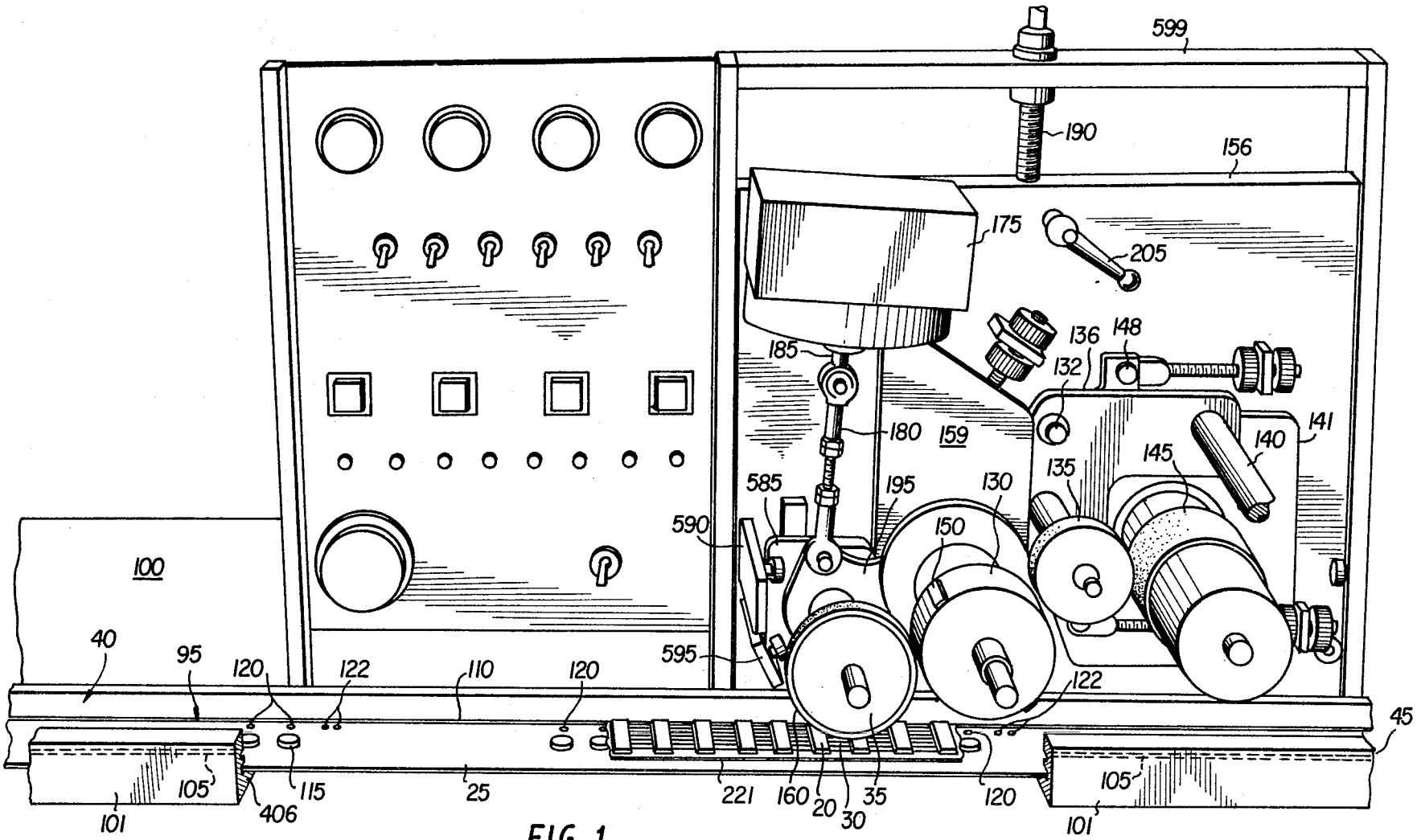
FIG. 1 is a front perspective view of a complete article printing system in accordance with the present invention.

FIG. 1 illustrates an article printing system in accordance with the present invention. Panel 15 includes, in addition to power switches, controls for adjusting the relative timing of the various operations carried out by the system in a manner to be described hereinafter. The articles 20 to be printed, which are typically small electronic components interconnected in strip form as shown, are conveyed by endless belt 25 in an intermittent manner from left to right toward the printing nip 30 beneath offset roll 35. The articles are placed on one end 40 of the endless belt by a loader, not shown, and removed from the opposite end 45 for further finishing steps, such as ultraviolet curing, by apparatus also not shown. The loader and ultraviolet curing station are conventional and form no part of the present invention.

Figure 2:
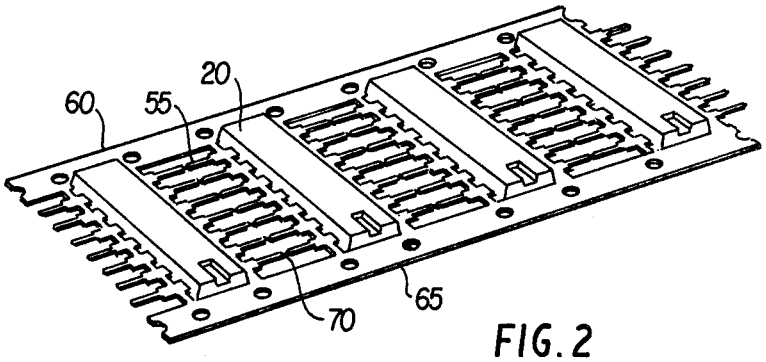
FIG. 2 depicts in perspective an interconnected series of integrated circuit dual inline packages on which identifying indicia may be printed by the system shown in FIG. 1.

FIG. 2 illustrates a series of interconnected dual inline packages 20 which are representative of the type of electrical components upon which printed indicia may be placed by the system shown in FIG. 1. The individually molded packages 20 are interconnected, in the course of fabrication, by their respective metallic leads 55 and by peripheral metallic flanges 60 and 65, collectively referred to as a lead frame. Typically, ten such packages are interconnected in the manner shown to form a discrete strip of components. Prior to sale to the ultimate user, the packages are separated by snipping the leads 55 at weakened points 70 and by removing flanges 60 and 65 entirely.

Figure 4:
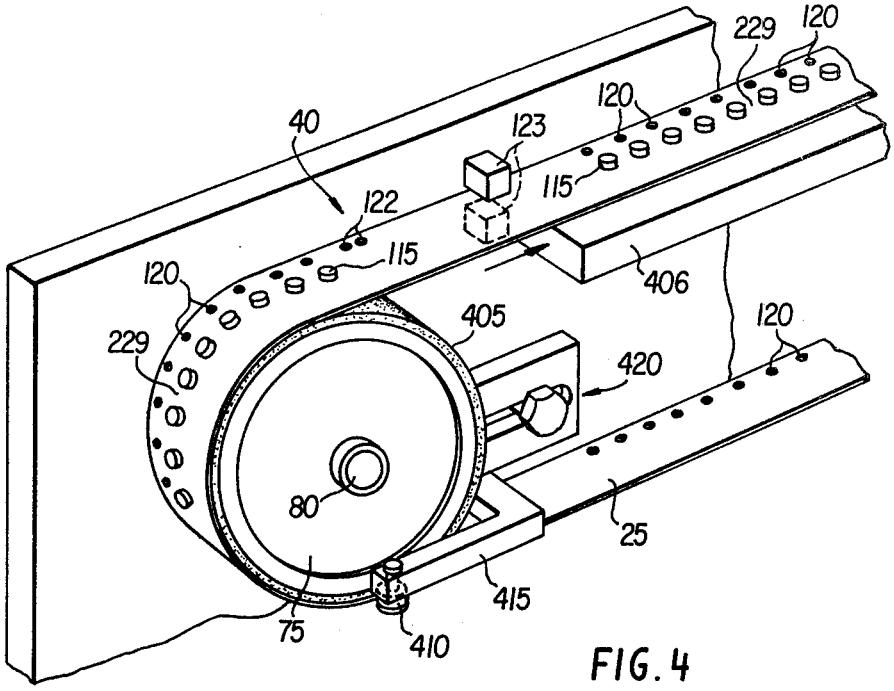
FIG. 4 is a perspective view of a portion of the endless belt employed in the system of FIG. 1, including an idler pulley therefor.

Referring now to FIG. 4, the left-hand portion of endless belt 25 is shown stretched around idler pulley 75, which is journalled for free rotation on shaft 80. For reasons of minimizing inertia, belt 25 is preferably a thin endless strip of stainless steel which travels across the surface of a fixed supporting shelf 406. A suitable pulley for use with such a belt, as illustrated in FIG. 4, includes a peripheral layer of rubber 405 whose width is slightly less than the transverse dimension of the belt 25, so that the lateral edges of the belt protrude slightly beyond the edges of the rubber layer 405. Roller bearing 410, together with a similar bearing (not shown) mounted in a corresponding position on the opposite side of the pulley 75, make rolling contact with the edges of the belt 25 in order to insure that it remains properly seated on the peripheral rubber layer 405. Support arm 415, which is affixed to the idler pulley tensioning device indicated generally by reference numeral 420, provides a suitable mounting for the bearing 410. A similar support arm, not shown, is provided for the bearing on the opposite side of the pulley 75.

The right-hand portion of belt 25 is stretched around a similar pulley, not shown, which is fixedly mounted on the output shaft of a vacuum-actuated clutch and brake device, also not shown in FIG. 4. The last-mentioned device, whose operation will be described in more detail hereinafter, functions to impart the necessary intermittent motion to the endless belt 25 from a suitable constant speed A.C. electric motor and gear reducer.

Referring again to FIG. 1, the central portions of support shelf 406 and front lip 101 have been cut away to reveal the manner in which endless belt 25 travels along the bottom of a channel 95 in feed table 100. The channel 95 has a rectangular cross-section and includes support shelf 406 (FIG. 4) at the bottom thereof. Opposed longitudinal grooves 105 and 110 are formed in the vertical walls of channel 95 to form horizontal trackways for slidingly receiving the peripheral flanges 60 and 65 (FIG. 2) of the interconnected electronic components 20 carried by the belt 25. The belt itself is studded with a number of upwardly projecting alignment pins 115 which are spaced and dimensioned so as to fit into the interstices between interconnected electronic components 20 in order to positively locate the components along predetermined segments of the belt and to transmit the intermittent motion of the belt thereto. The vertically restraining effect of the flange-receiving grooves 105 and 110 insures that efficient contact is maintained between alignment pins 115 and components 20.

Endless belt 25 is further provided with a row of small holes or perforations 120 extending parallel to one edge thereof. These perforations are more clearly visible in FIG. 4, where the strip of electronic components has been removed for clarity. The relationship of these perforations to the alignment pins is such that one perforation is provided adjacent to the position occupied by each article on the belt. As will be described in more detail hereinafter, these perforations, which are referred to as print-stop perforations, cooperate with a print station photoelectric detector (not shown in FIG. 1 or FIG. 4) located adjacent to the printing nip 30 to abruptly halt the motion of the belt when the next article to be printed arrives at a temporary rest or "ready" position located a predetermined distance in advance of the printing nip. Thus, the spacing between successive print-stop perforations, while not necessarily uniform or regular, must be made equal to the center-to-center spacing of the successive articles on the belt to which they correspond. Accordingly, when the spacing of articles on the belt is changed, a new belt with correspondingly spaced perforations and alignment pins must be installed on the idler and drive pulleys. This is facilitated by loosening idler pulley tensioning device 420 (FIG. 4) in the known manner.

When the articles to be printed comprise discrete strips of interconnected components of the sort previously described with reference to FIG. 2, the line of alignment pins 115 on endless belt 25 is broken at intervals to create spaced strip-receiving belt segments 229 separated by vacant segments 230 as suggested in FIG. 1 and shown more clearly in FIG. 4. Each strip-receiving segment is preceded by two additional belt perforations 122, designated load station perforations, which are located along the line defined by the print-stop perforations but are separated by a characteristic distance which is preferably much smaller than the smallest contemplated spacing between print-stop perforations. A second photoelectric detector 123 (FIG. 4), which will be referred to as the load station detector, is provided near the article loading end 40 of the belt 25. As the load station perforations pass detector 123, their characteristic spacing is detected in order to halt the printing system for loading of a new component strip on the next strip-receiving belt segment. The vacant sections 230 of the belt 25 are of a length sufficient to insure that the previous component strip has been completely printed when the load station perforations preceding the next strip-receiving segment of the belt are sensed by detector 123.

Since precise control of the position of intermittently moving belt 25 is important in insuring accurate and repeatable registration of the printed images on offset roll 35 with the upper surface of the components 20 to be printed, it is desirable to keep the moving mass of the belt to a minimum to reduce inertial startup lag and overshoot. It has been found that a particularly suitable belt can be made from a strip of stainless steel approximately 0.008 inch thick and 2 inches wide, made endless through the use of an electron beam welder. The alignment pins are preferably molded in two parts from a light plastic material, such as glass-filled polypropylene, and fastened together by ultrasonic welding or a suitable adhesive through rows of holes extending lengthwise along the center of belt 25.

The printing elements of the system shown in FIG. 1 include offset roll 35, die roll 130, inking roll 135, and inking reservoir roll 145. Together these elements comprise what may be referred to as the print head. Inking reservoir roll 145 cooperates with an ink reservoir which is conventional and has been omitted for clarity. The present invention preferably uses a Model 20A inking apparatus sold by Markem Corp., the assignee of the instant application. Fixed supporting bar 140, a portion of which is shown in FIG. 1, projects from plate 136 to support and position the ink reservoir about the reservoir roll 145 in the conventional manner. The function of reservoir roll 145 is to maintain an even film of ink on the surface of inking roll 135, which in turn supplies an even coating of ink to the faces of the printing dies 150 and 155 secured approximately 180° apart on the circumference of die roll 130. The circumferential printing surface 160 of offset roll 35 receives printed images from inked printing dies 150 and 155 for eventual transfer to the articles 20 as they are propelled through the printing nip 30, which is the point of closest approach between the surface of endless belt 25 and the lower periphery of offset roll 35. When two printing dies are secured on the die roll 130 in the manner shown, two articles can be printed per revolution of the die roll.

Figure 3:
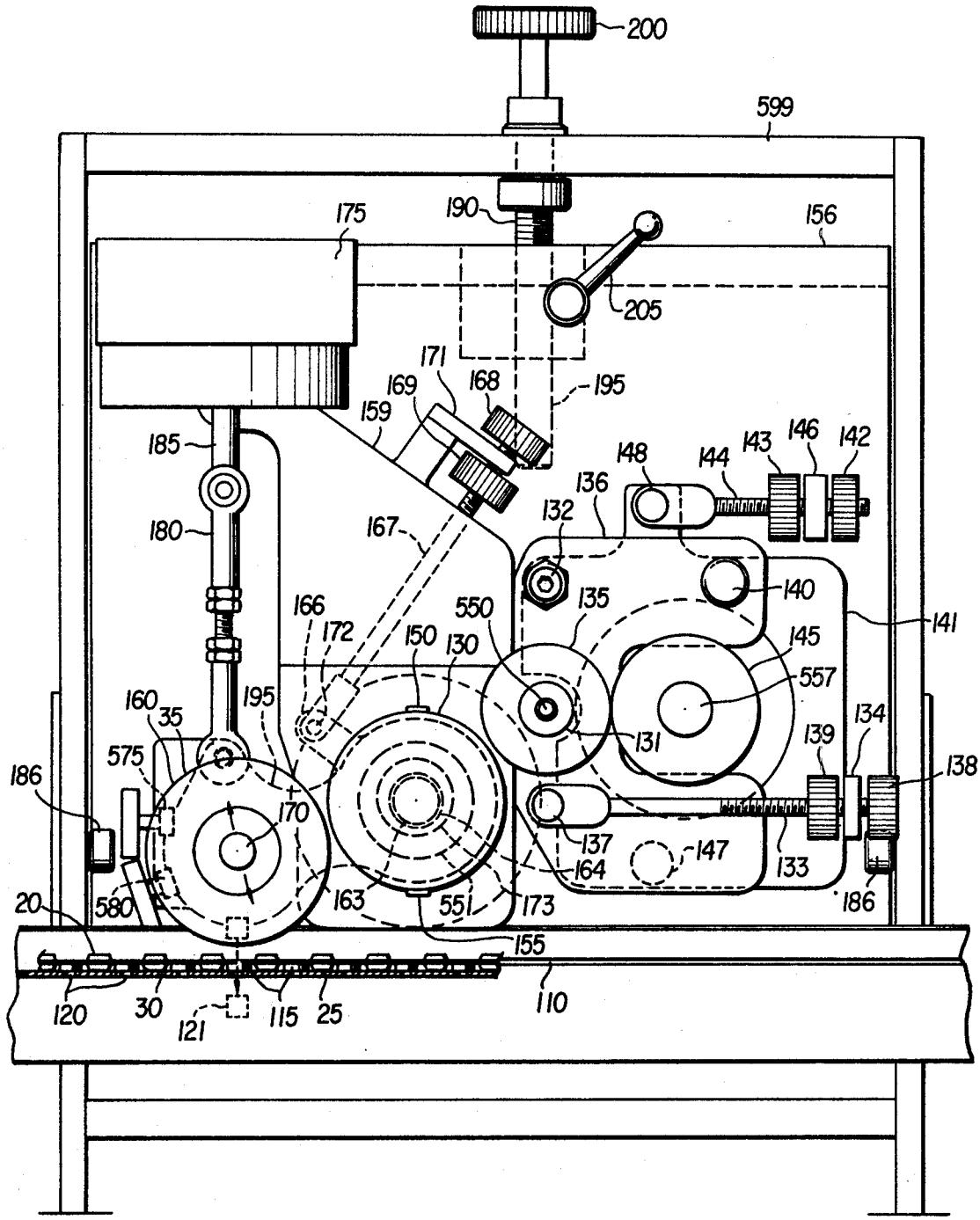
FIG. 3 is a detailed front elevational view of the rotary offset printing elements and the article printing station of the system shown in FIG. 1.

FIG. 3 is a more detailed view of the print head section of FIG. 1, from which the operation of certain mechanical adjustment and reciprocation apparatus will be more clearly apprehended. With reference to FIG. 3, the positions of reservoir roll 145 and inking roll 135 may be individually adjusted by means of pivotable overlapping plates 141 and 136. Plate 141 functions as the support for a shaft 555 (visible in FIG. 6) which is coupled to the shaft 557 of reservoir roll 145. Plate 136 similarly supports inking roll shaft 550, which is enclosed in a tubular casing 131 (shown in phantom). When knurled adjusting nuts 142 and 143 are loosened to allow threaded rod 144 to move freely through apertured support member 146, plate 141 may be pivoted about pivot point 147 to adjust the position of the reservoir roll shaft. Pivotable connection 148 between rod 144 and plate 141 facilitates this adjustment. When the reservoir roll 145 has been aligned as desired, adjusting nuts 142 and 143 are tightened against support member 146 to lock the reservoir roll in position. Inking roll shaft 550 is journalled through an aperture in plate 136, which partially overlaps plate 141, to allow adjustment of the inking roll position in a similar manner. In this case, plate 136 is pivoted about point 132 by displacing threaded rod 133 through apertured support 134. Rod 133 is pivotably connected to plate 136 at point 137 to facilitate this adjustment. When the inking roll 135 has been positioned as desired, adjusting nuts 138 and 139 are tightened against support member 134 to lock the inking roll in place. Back plate 156 serves as the supporting structure for apertured support members 146 and 134 and for the pivot points 147 and 132 about which plates 141 and 136 are pivoted for adjustment purposes.

Figure 6:
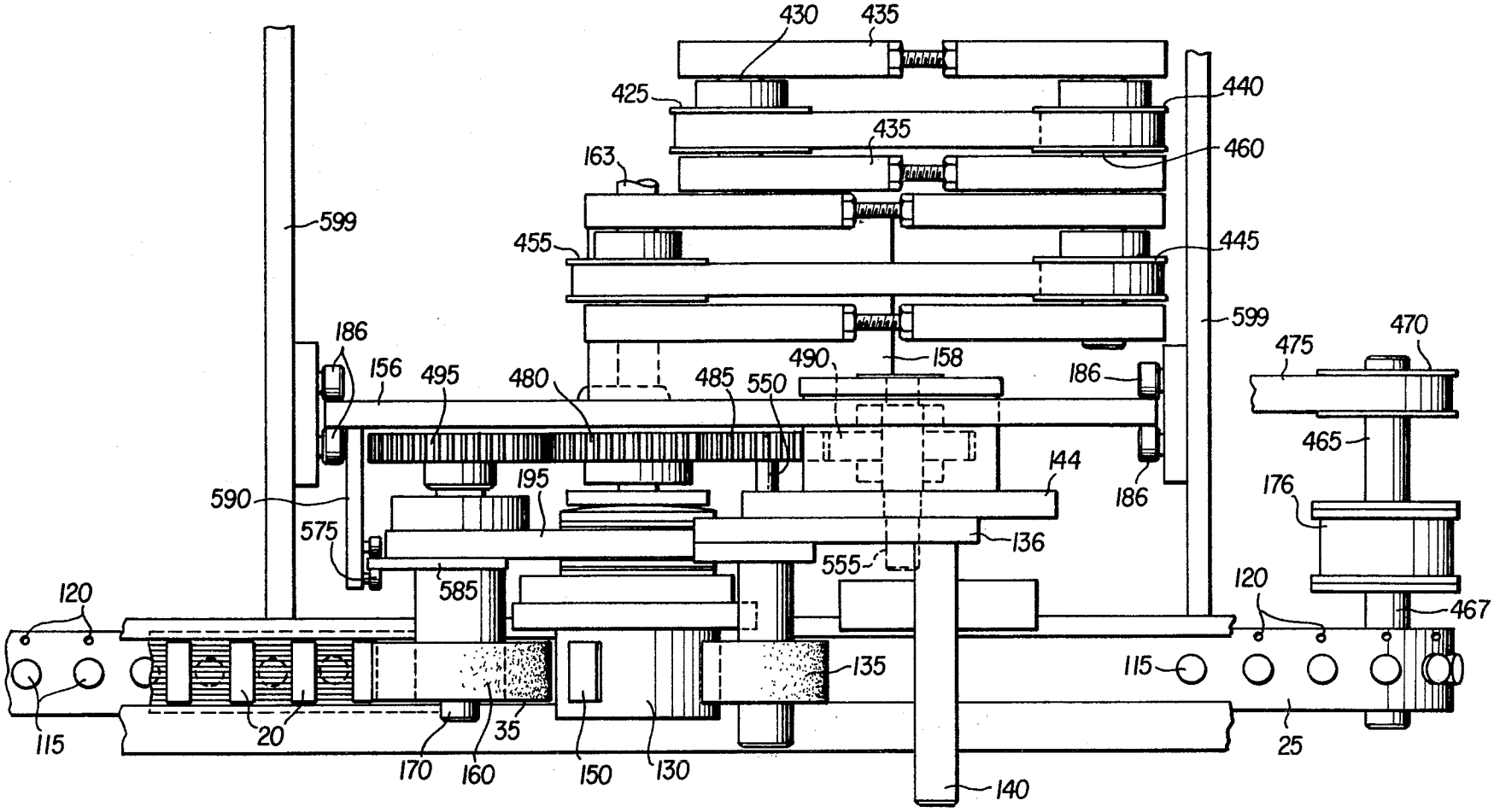
FIG. 6 is a plan view showing the driving apparatus for the rotary offset printing elements and the endless belt in the system of FIG. 1.

Referring now to the plan view of FIG. 6, reference numeral 158 represents a suitable constant speed A.C. drive motor and gear reducer unit for turning the shafts of offset roll 35, die roll 130, inking roll 135 and reservoir roll 145 (FIG. 3), and for providing driving torque to the endless belt 25. The motor and gear reducer unit 158 is attached to a fixed frame member (not shown) below the lower edge of back plate 156 which, for reasons which will shortly become apparent, is vertically movable for adjustment purposes between guide rollers 186. The unit 158 has an output shaft 430 to which is attached a pulley 425. Drive belt 151 transmits rotary motion from pulley 425 to a second pulley 440, which in turn rotates shaft 460 and a further pulley 445 affixed thereto. Support and tensioning bars 435 and 436 provide support for shaft 460 and allow the latter to serve as a floating hinge between belt 151 and a further belt 450, which transmits rotary motion from pulley 445 to a further 455 affixed to the die roll shaft 163. Thus when back plate 156 is moved up or down between guide rollers 186, carrying die roll shaft 163 along with it, an efficient rotary mechanical linkage is maintained between motor and gear reducer output shaft 430 and die roll shaft 163.

Die roll shaft 163 is journalled through back plate 156 for the purpose of driving die roll 130 and turning a spur gear 480. Gear 480 meshes with a second gear 495 for driving offset roll shaft 170 and hence offset roll 35, and with a further gear 485 for driving inking roll shaft 550 and thus inking roll 135. Gear 485 in turn meshes with a further gear 490, which turns shaft 555. Shaft 555 is the source of rotary motion for the reservoir roll shaft 557 (FIG. 3), and is normally provided with a mechanical coupling device (not shown) for mating with a similar coupler on the reservoir roll shaft, whereby the inking apparatus as a whole may be removed for servicing by sliding the same off the end of supporting bar 140. For the sake of clarity, neither the ink reservoir nor the reservoir roll have been shown in FIG. 6. It should be pointed out that the above-described gear train permits of some backlash variation to permit the inking roll and reservoir roll adjustments described previously.

The respective ratios of gears 480, 485, 490 and 495 of FIG. 6 are chosen such that the circumferential speeds (i.e., the linear speed of a point on the circumference) of the offset, die, inking and reservoir rolls are matched as closely as possible. In the case of the die roll, of course, it is the circumferential speed at the surfaces of projecting printing dies 150 and 155 (FIG. 3) that is matched to the circumferential speeds of the remaining rolls. In addition, the radius of the offset roll is chosen to be equal to the effective radius of the die roll (i.e., measured to the projecting surfaces of the printing dies 150 and 155 in FIG. 3), so that the angular displacement of a given one of the printing dies will always be equal to the angular displacement of the printed image it has transferred to the peripheral printing surface 160 of the offset roll 35.

Also visible in the plan view of FIG. 6 is a vacuum-actuated clutch and brake unit 176 for imparting the necessary intermittent motion to endless belt 25 by means of output shaft 467 and drive pulley 85 in response to suitably timed electrical input signals. Drive pulley 85 is similar to idler pulley 75, which has been described above in connection with FIG. 4. The clutch and brake unit 176 receives driving torque from motor and gear reducer 158 by means of pulley 470 and endless belt 475, which is in turn driven by a second output shaft (not shown) from the motor and gear reducer unit 158. The shaft speed provided to unit 176 by reducer 158 is chosen such that, when unit 176 is engaged for driving belt 25, the linear speed of belt 25 is equal to the circumferential speed of offset roll 35. This is important in assuring a smooth transfer of the printed images from the peripheral surface of the offset wheel to the surfaces of the articles 20 to be printed.

In the interest of controlling the stopping and starting of endless belt 25 with as little positional error as possible, an oversized brake and clutch unit 176 is used in order to counteract the inertia of the belt and of the articles carried thereon. A suitable A.C. motor-driven pump (not shown) provides a source of vacuum for the unit 176. The preferred clutch and brake unit for this purpose is a Foret Model SCB07, manufactured by Foret Systems of Cape Cod, Mass., although any clutch and brake unit of sufficient capacity, vacuum-actuated or otherwise, could be used. Alternatively, the motion of the endless belt 25 could be controlled by a D.C servo drive unit, slaved alternatively to a tachometer on the die roll shaft (for a printing speed reference) and to a fixed frame point (for a zero-speed reference).

In accordance with an important aspect of the present invention, the shaft 170 of offset roll 35 in FIG. 3 is mounted for vertical reciprocation in order that printing surface 160 may be brought alternately into and out of contact with the upper surfaces of the articles 20 to be printed. This is accomplished by a vacuum-operated linear actuator 175, which imparts the necessary vertical reciprocating motion to connecting rod 180 and thence to offset roll shaft 170 in response to periodic electrical input signals.

The vacuum actuator 175 is constructed from an airtight chamber which contains a movable diaphragm (not shown) that is connected to the actuator output 185 illustrated in FIG. 3. The chamber consists of an upper section and a lower section which are defined by the movable diaphragm and the wall of the chamber. The diaphragm forms a pressure-tight seal between the two sections of the chamber. The pressure-tight seal permits a source of vacuum and atmospheric air to be applied respectively to the two sections of the chamber to cause movement of the diaphragm to raise or lower the offset roll. Each section of the chamber has a solenoid actuated three-port valve formed integrally within that section of the chamber wall. Each valve has a port which opens into its associated chamber section and two ports on the outside of the chamber section which are respectively connected to the atmosphere and a source of vacuum. Energization of the solenoid coil of each valve permits the selective connection of the port which opens into the chamber section to either atmospheric pressure or the vacuum source, the latter being provided by the A.C motor-driven pump referred to previously.

To move the offset to the down position, the upper section of the chamber is connected to the atmosphere by solenoid actuation of its valve to cause the outside port which is coupled to the atmosphere to be connected to the port opening within the chamber section, and the lower section is evacuated by coupling the outside port of its valve which is coupled to the source of vacuum, to be connected to the port opening within the chamber section.

To move the offset roll to the up position, the upper chamber section is evacuated and the lower chamber section is coupled to the atmosphere by solenoid actuation of the valves so that the outside port of the upper chamber section valve which is coupled to the vacuum source, is connected to the port opening within the upper chamber section and the outside port of the lower chamber section valve which is coupled to the atmosphere, is connected to the port opening within the lower chamber section valve.

Figure 5A:
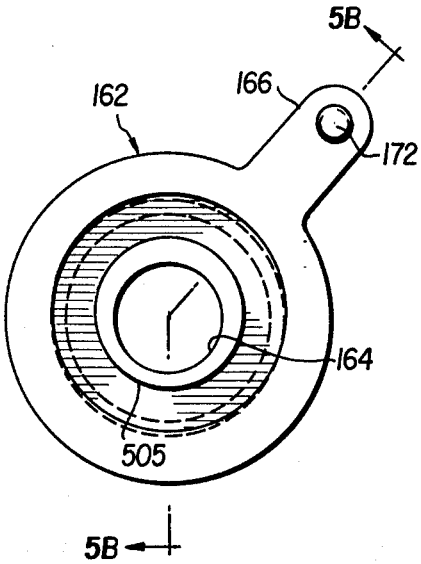
FIGS. 5A and 5C are rear and front elevational views, respectively, of a flanged eccentric device used to adjust die roll pressure.
Figure 5B:
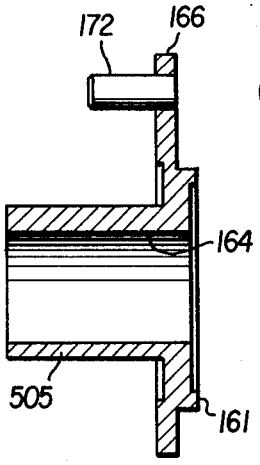
FIG. 5B is a side sectional view along the line 5B in FIG. 5A.
Figure 5C:
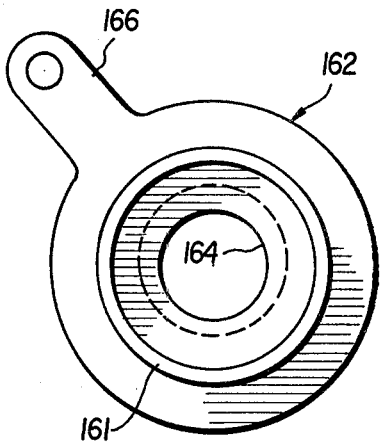

Referring again to FIG. 3, connecting rod 180 is pivotably connected at its upper extremity to the reciprocating output 185 of linear actuator 175. At its lower extremity 190, connecting rod 180 is pivotably connected to one lobe of an elongated yoke 195 (shown in phantom) in which the offset roll shaft 170 is rotatably supported. The second lobe of the yoke 195 extends behind the die roll 130 and contains a circular aperture 173 for snugly but rotatably receiving the projecting annular stud 505 of an eccentric device 162 which is illustrated in FIGS. 5A–5C and enables die roll pressure to be adjusted as will be described hereinafter. Annular flange 161 of the eccentric device 162 is in turn rotatably received by a correspondingly dimensioned circular aperture 551 in a mounting plate 159, which is affixed to back plate 156. Bore 164 in the eccentric device provides appropriate clearance for the die roll shaft 163. The vertical reciprocation of connecting rod 180, when transmitted to the yoke 195 at pivot connection 190, therefore causes the axis of offset roll shaft 170 to trace a small arc (shown) whose center lies on the axis of the fixed die roll shaft 163 (shafts 170 and 163 remaining at all times parallel), since the die roll shaft is concentric with the bore 164 and annular flange 161 of the eccentric device of FIGS. 5A–5C.

Since yoke 195 is cantilevered by a substantial distance with respect to its point of support at eccentric device 162, guide rollers 575 and 580 are maintained in rolling contact with a flange-like extension 585 affixed to the yoke 195 in order to maintain the yoke in proper alignment. Two additional rollers (not shown in FIG. 3) are provided opposite rollers 575 and 580 for making rolling contact with the opposite side of the extension 585, as suggested in the plan view of FIG. 6. Support brackets 590 and 595 are attached to back plate 156 to provide mounting points for the guide rollers.

In practice, the total vertical travel of reciprocating offset roll 35 with respect to endless belt 25 will be on the order of one-sixteenth of an inch. Planetary movement between the meshing gears 495 and 480 (FIG. 6) that correspond to the offset and die rolls, respectively, permits this displacement.

Adjustment of die roll pressure may now be described with respect to FIGS. 3 and 5A–5C. With particular attention to the side section view of FIG. 5B, it will be observed that the outside diameter of projecting stud 505 is eccentric with respect to annular flange 161 and clearance bore 164. Recalling that projecting stud 505 is rotatably received in a circular aperture 173 in the yoke 195 of FIG. 3, and that the opposing annular flange 161 is rotatably received in a circular aperture 551 in the mounting plate 159, it follows that rotation of the eccentric device 162 while it is received in these apertures will result in lateral movement of the yoke 195, and of the offset roll shaft 170 rotatably mounted therein, with respect to the fixed axis of annular flange 161, clearance bore 164, and die roll shaft 163, which are all concentric. This has the effect of varying the distance between offset roll shaft 170 and fixed die roll shaft 163, whereby the pressure exerted by the die roll printing dies 150 and 155 on the resilient peripheral surface 160 of the offset roll 35 may be adjusted as desired. With the eccentric device of FIGS. 5A–5C seated in the apertures 173 and 551, this adjustment is made by displacing threaded connecting rod 167 (FIG. 3), which is pivotably connected to a stud 172 on a projection 166 extending from the eccentric device. When the offset roll 35 has assumed the desired position, knurled adjustment nuts 168 and 169 are tightened onto apertured support 171, which is affixed to the mounting plate 159, in order to lock the threaded end of connecting rod 167 in place.

Printing is accomplished by the rolling frictional engagement between the rotating offset roll 35 and the top surfaces of the articles 20 carried by endless belt 25 during the intervals when the offset roll assumes its lowered position. In order for printing to be carried out on articles of different heights, an adjustment apparatus is provided to vary the vertical position of the supporting back plate 156 in FIG. 3 with respect to the fixed frame 599 of the printing apparatus. In particular, threaded shaft 190 is rotatably mounted in frame 599 and mated to a tapped bore 195 in back plate 156. Rotation of the adjusting knob 200 secured to shaft 190 thus causes back plate 156 to move up or down with respect to form 599 and belt 25. Suitable guide rollers 186 are provided to maintain the vertical alignment of back plate 156 during its vertical travel. Since back plate 156 carries offset roll 35, die roll 130, inking roll 135, reservoir roll 145, and the linear actuator 175, vertical displacement of back plate 156 effectively moves the upper and lower reciprocation limits of offset roll 35 by an equal vertical distance, the amount of reciprocation remaining the same. It is therefore possible to adjust the lower position of offset roll 35 to match the height of the particular articles 20 to be printed. Locking handle 205 is then engaged to force an eccentric member against shaft 190 in the known manner, thereby maintaining shaft 190 in the selected position. With reference to FIG. 6, it will be recalled that the "hinged" arrangement of drive belts 151 and 450 allows rotary motion to be transmitted from the fixed motor and gear reducer unit 158 to the die roll shaft 163 regardless of the vertical position of the movable back plate 156.

Figure 7:
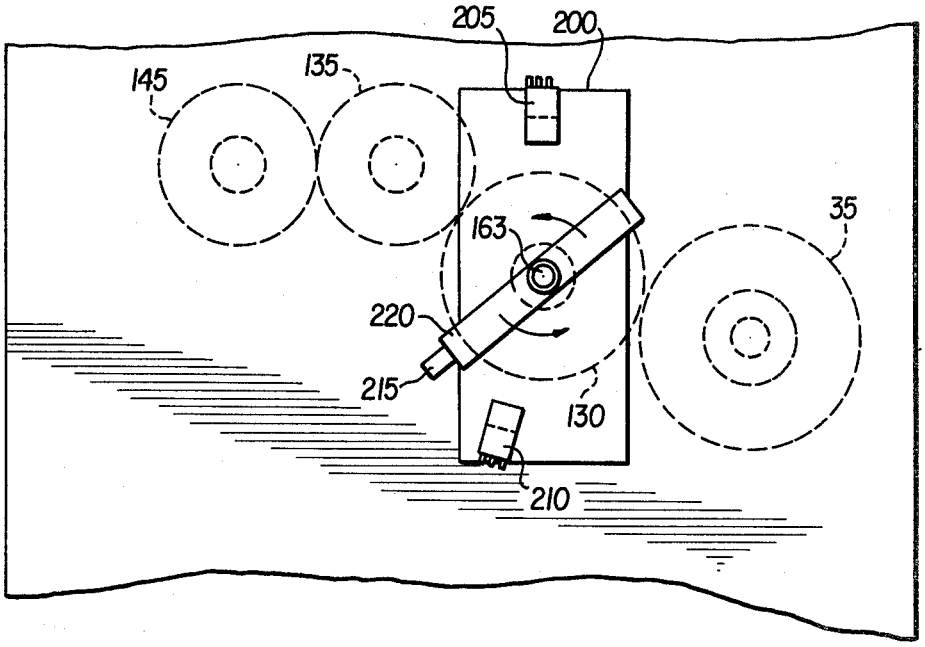
FIG. 7 is a rear elevational view of a portion of the system of FIG. 1, showing the back of the die roll shaft and the Hall effect angular position sensing apparatus cooperating therewith.

FIG. 7 is a rear elevational view of a portion of the printing system of FIG. 1 showing the end of die roll shaft 163 opposite that to which the die roll 130 (FIG. 6) is attached. Recalling that die roll 130 and offset roll 35 have the same effective radius and are driven at the same rotational speed, it follows that the angular displacement of the die roll shaft 163 will provide an indication of whether a printed image that was previously transferred to the offset roll from the die roll has rotated to a position of alignment or predicted registration with the article awaiting a print below. FIG. 7 illustrates an angular position sensing system for providing such an indication. Die roll shaft 163 is journalled through mounting plate 200, to which are also affixed first and second Hall effect switches 205 and 210 corresponding to first and second printing dies 150 and 155 on die roll 130 (FIG. 3). Preferably the Hall effect switches are Honeywell type 1AV3A "Microvane" devices. The two Hall switches produce output signals in response to the proximity of an iron vane 215 secured to one end of a rotor 220. Rotor 220 is secured to die roll shaft 163 so that the rotation of the die roll shaft will cause output signals to be produced by each of Hall switches 205 and 210 in turn.

By choosing the proper angular orientation of rotor 220 on die roll shaft 163, an output signal will be obtained from one of sensors 205 or 210 when the printed image deposited on the offset roll 35 by the corresponding printing die 150 or 155 has rotated to a position of predicted registration with the surface of the article waiting motionless in a predetermined rest or ready position below. Referring to FIG. 3, the predicted registration position of the offset roll may be defined as (ignoring for the moment certain adjustments to be explained hereinafter) the angular position of the offset roll at which the endless belt 25 must be restarted in order for the printed image on the periphery 160 of the offset roll 35 (FIG. 3) and the desired print location on the upper surface of the next article 20 to reach the printing position defined by the printing nip 30 at the same time.

Since the printing dies 150 and 155 will not always be spaced by exactly 180° on the circumference of the die roll 130 (FIG. 3), it is desirable to provide for adjustment of the angular position sensing apparatus of FIG. 7 to account for this situation. Accordingly, Hall switches 205 and 210 are mounted approximately 165° apart on plate 200, as measured in the direction of rotor rotation, rather than in direct 180° opposition. Assuming counterclockwise rotation of the rotor 220 in FIG. 8, Hall switch 210 will therefore produce an output pulse earlier in time with respect to the output of switch 205 than would have been the case if the switches were affixed on plate 200 in direct 180° opposition. As will be described in more detail hereinafter, a variable time delay circuit is included in the output of Hall switch 210 so that its output signal may be made to appear earlier than, later than, or coincident with the 180° point, as required by the particular spacing of printing dies on the die roll.

Figure 8:
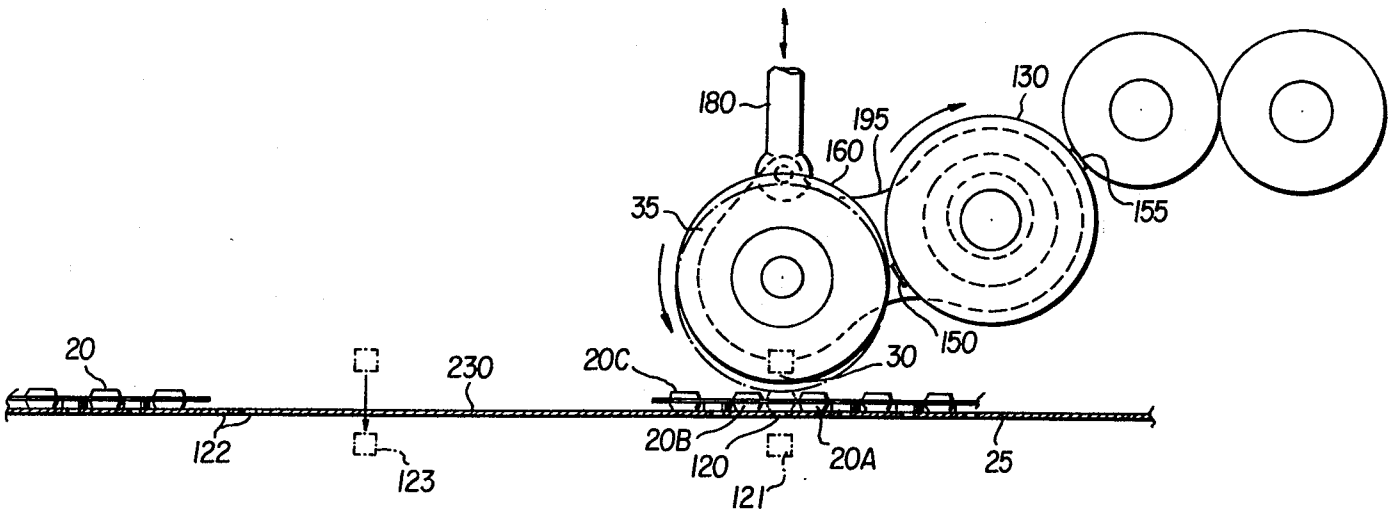
FIG. 8 is a simplified front elevational view of the rotary offset printing elements (or "print head") of the system of FIG. 1 and the articles printed thereby, representing the progress of a single printing cycle.

The mechanical operation of the printing system of the present invention may now be described with reference to FIG. 8, which is a somewhat simplified representation of the progress of the print head through representative stages of a single printing cycle. As pointed out previously, die roll 130 and offset roll 35 are driven continuously and in synchronism, the two inked printing dies 150 and 155 serving to transfer printed images to the circumferential printing surface 160 of offset roll 35. It will be understood that it is equally within the scope of the present invention to provide more than two printing dies or only a single die along the circumference of die roll 130. In the preferred embodiment illustrated in FIG. 3, however, two printing dies 150 and 155 are secured approximately 180° apart on die roll 130.

It will be assumed for convenience that a printing operation has just been performed on an article 20A and endless belt 25 is moving from left to right. Offset roll 35 has been restored to its upper retracted position (solid outline). As the next article 20B approaches the printing position defined by the printing nip 30 directly below offset roll 35, the print-stop perforation 120 corresponding to that article aligns with print station photoelectric detector 121 located adjacent to the printing nip. The position of the print-station detector 121 with respect to the printing nip 30 is such that print-stop perforation 120 aligns with the detector when the leading edge of the corresponding article 20 has arrived at a predetermined rest or "ready" position a short distance in advance of the printing nip (article 20B is represented in solid outline in the ready position in FIG. 8). When this occurs, a signal from detector 121 is sent to the controlling microprocessor, which will in turn causes vacuum-actuated clutch and brake unit 176 (FIG. 6) to abruptly stop the motion of endless belt 25 and to disengage the driving torque therefrom.

Coarse adjustment of the location of the ready position relative to the printing nip 30 may be accomplished by physically displacing detector 121 in the appropriate direction along the line of belt travel. In addition, as will be described in more detail hereinafter, variable time delay circuitry is interposed between the output of detector 121 and the microprocessor input in order to allow fine adjustment of the ready position by means of an external potentiometer.

With endless belt 25 now stopped and article 20B maintained in the ready position, offset roll 35 and die roll 130 continue to rotate uniformly. This is possible since offset roll 35 is held in its upper retracted position (solid outline) by linear actuator 175 (FIG. 3) and connecting rod 180 at this time and therefore cannot make premature frictional contact with either the motionless leading edge of the waiting article 20B or the motionless trailing edge of the previous article 20A.

As offset roll 35 rotates, the printed image previously transferred to its circumferential surface 160 by one of printing dies 150 or 155 eventually reaches a point of predicted registration with the motionless surface of the waiting article 20B below. This angular position of the offset roll is indicated by an output signal from one of the Hall effect switches 205 or 210 comprising the die roll angular position sensor previously described with respect to FIG. 7. When this point is reached, the output signal produced by Hall effect switch 205 or 210 is applied as an input to the controlling microprocessor, which responds by signalling vacuum-actuated clutch and brake unit 176 (FIG. 6) to restart the forward motion of endless belt 25. As will be set forth in more detail hereinafter, variable time delay circuitry is interposed between the microprocessor output and the clutch and brake unit 176 in order to permit manual adjustment, by means of an external potentiometer, of the delay period between the restart signal from the microprocessor and the actual restarting of the belt 25 by clutch and brake unit 176. This has the effect of varying the registration position along the surface of article 20B at which the printed image will be deposited by offset roll 35. Accordingly, this delay period is referred to as the registration delay. Clearly, the longer this delay period is adjusted to be, the closer the printed image will be located to the leading edge of article 20, since the image will have moved farther in a counterclockwise direction along the periphery of offset roll 35 during the delay interval.

When the registration delay is over, the signal is sent to the microprocessor to indicate that the endless belt 25 has been restarted. The microprocessor responds by signalling the linear actuator 175 (FIG. 4) to lower the offset roll 35 to its lower or article-printing position by means of connecting rod 180. The circuitry that propagates this signal includes two time delay adjustments, the first of which (referred to as the compensation delay) delays the response of linear actuator 175 for a period of time sufficient to allow endless belt 25 to reach full speed before offset roll 35 is fully lowered. During this interval, the leading edge of the article 20B which is to be printed traverses the distance from the ready position to the printing position defined by the printing nip 30, where it is met by the now fully lowered offset roll 35. The positions of article 20B and offset roll 35 at this point are represented in phantom outlines in FIG. 8.

As article 20 passes through the printing nip 30, the rolling contact between the surface of the article and the circumferential surface 160 of the offset roll 35 causes transfer of the printed image to the article. As pointed out previously, the circumferential surface speed of the offset roll is matched as closely as possible to the linear speed of the endless belt 25 to insure that the image is transferred to the article smoothly and with no distortion.

After a time delay interval sufficient to allow transfer of the entire printed image to the surface of article 20, offset roll 35 is restored to its raised or retracted position by linear actuator (FIG. 7) and connecting rod 180. This delay interval, which is referred to as the dwell time of the offset roll, is adjustable by means of an external potentiometer to accommodate printed inidicia of different lengths and constitutes the second of the two time delay adjustments referred to above in connection with the circuit for controlling linear actuator 175. It will normally be desirable to adjust the dwell time so that the offset roll begins to rise as soon as the image has been transferred and does not make contact with the trailing portion of the article 20B. By promptly "breaking" the printing nip in this manner, smearing by the offset roll of the printed image just transferred is prevented.

After offset roll 35 has been restored to its upper retracted position, the motion of endless belt 25 continues as before to propel the next article 20C toward the printing nip. The possibility of premature engagement of the offset roll 35 with the leading edge of the next article 20C (as well as the possibility of undesirable contact between the offset roll and the trailing edge of the article 20B), which is a particular problem when the articles are small and closely spaced, is avoided during this interval since the offset roll is retracted to a position safely above the surfaces of the articles. When the next print-stop perforation aligns with print-station detector 121 to indicate that the next article to be printed has arrived at the ready position, the endless belt 25 is halted in preparation for another printing cycle and the sequence of operations described above is repeated.

In an optional "two-up" mode of operation, two articles are printed during the time the offset roll 35 remains in its lowered position. In this case, two additional printing dies are secured to the die roll 130 of FIG. 3 (for a total of four dies). Each of the additional dies is located at a point spaced counterclockwise on the die roll from one of the dies 150 and 155 (with which the Hall effect sensors 205 and 210 of FIG. 7 are associated) by a distance equal to the spacing between the articles on the endless belt 25. The microprocessor is programmed (in a manner to be described hereinafter) to ignore every second print-stop perforation that is sensed by the print station detector 121. In addition, the dwell time of the offset roll 35 is increased to a period sufficient to allow it to make rolling contact with two successive articles while it is in its lowered position. Thus, when the Hall effect switch associated with printing die 150 (or 155) produces an output signal indicating that an image on offset roll 35 is ready to be transferred, the offset roll will be lowered (and the belt 25 continued in motion) long enough for two successive articles to be printed, one with an image derived from printing die 150 (or 155) and the other with an image derived from the additional printing die associated with the printing die 150 (or 155). It will be observed that no modification of the die roll angular position sensing apparatus of FIG. 7 is required for this mode of operation.

Referring again to FIG. 8, and assuming that the articles to be printed are discrete strips of interconnected electrical components of the sort shown in FIG. 2, the last component on the strip will be followed by a vacant segment 230 of the endless belt 25 having neither alignment pins nor print-stop perforations. Thus, the belt will continue to move after the last component on a strip is printed, since no subsequent print-stop perforation will align with print-station detector 121 until the next strip-receiving segment of the belt 25 reaches the printing nip 30. Well before this occurs, however, the two load station perforations 122 that precede the next strip-receiving belt segment will pass the load station photoelectric detector 123. As noted previously, the two load station perforations 122 are spaced apart by a characteristic distance, typically much smaller than the spacing between print-stop perforations 120. When the characteristic spacing of the load station perforations is detected (based on the known fixed speed of endless belt 25) at detector 123, the printing system is brought to a halt in order to allow a loading device (not shown) to place a new strip of components 201 on the strip-receiving segment of belt 25 following the pair of load station perforations 122 just detected. When this has been accomplished, a manual start command places the system back into operation and the new strip of components is printed in the manner described above, except that the first two perforations to be detected by the print station detector 121 (which will necessarily be the load station perforations 122) are ignored by the controlling microprocessor and do not result in stopping of the belt or vertical reciprocation of the offset roll. The third and subsequent perforations are interpreted as print-stop perforations and will initiate printing cycles in the normal manner. In the two-up mode, the second and then every second following perforation is so interpreted.

It has been found advantageous to provide a dummy print-stop perforation as the first perforation following the two load-station perforations. Although the dummy perforation will initiate a print cycle, there is no article adjacent to it on the endless belt for receiving a print from the reciprocating offset roll 35. This permits the system to execute a complete cycle, and the vacuum levels at the clutch and brake unit 176 (FIG. 6) and linear actuator 175 (FIG. 4) to settle, prior to printing the first article of each new strip. In the interest of simplicity, dummy print-stop perforations have not been shown in the drawings.

Figure 9:
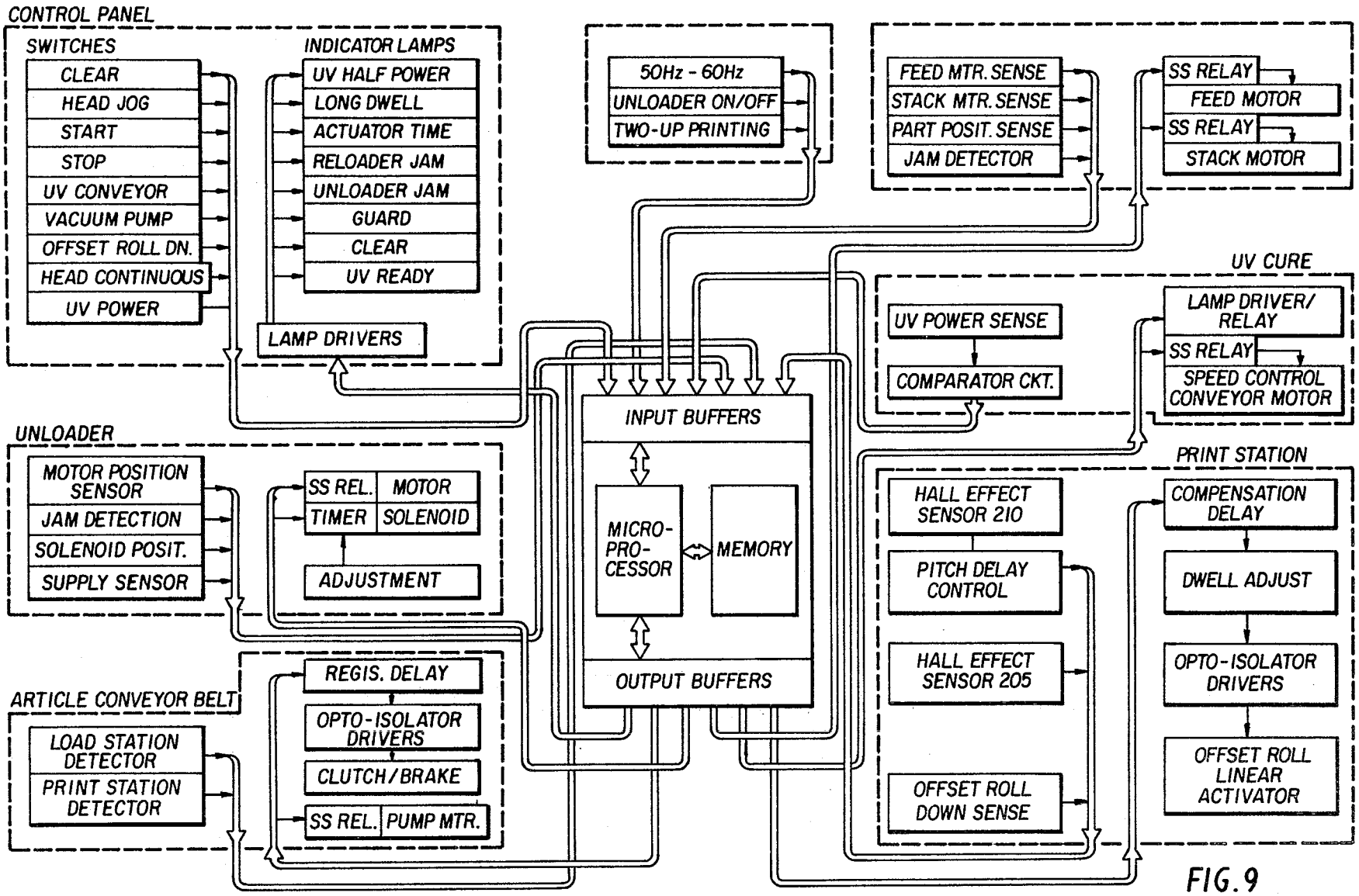
FIG. 9 is a block diagram illustrating generally the manner in which the various functional units of the present printing system interface with the controlling microprocessor.

FIG. 9 is a block diagram illustrating generally the manner in which control over the various operations carried out by the printing system of the present invention is, according to the preferred embodiment, centralized in an integrated microprocessor. An 8-bit Intel 8035 microprocessor has been found suitable for this purpose in connection with an 8755 erasable PROM for storing the necessary microprogramming. The unloader, reloader and ultraviolet curing station blocks are shown for completeness, since they may conveniently be controlled by the same microprocessor that controls printing operations, but they form no part of the present invention and accordingly will not be described in detail. Of primary interest are the article conveyor belt and print station blocks, together with certain of the control panel switches, indicator lamps and set-up switches as will be identified hereinafter. The interaction of the various functional units of the system will be more fully apprehended from the programming description which follows, taken together with the specific circuit diagrams to which reference will be made as the description proceeds.

The flowchart set forth in FIGS. 10A–10E is a functional description of the manner in which the microprocessing system of FIG. 9 is programmed in order to carry out the operations that have so far been described. Implementation of the flowchart of FIGS. 10A–10E in terms of specific microprogramming steps will vary somewhat according to the particular microprocessor hardware chosen.

Figure 10A:
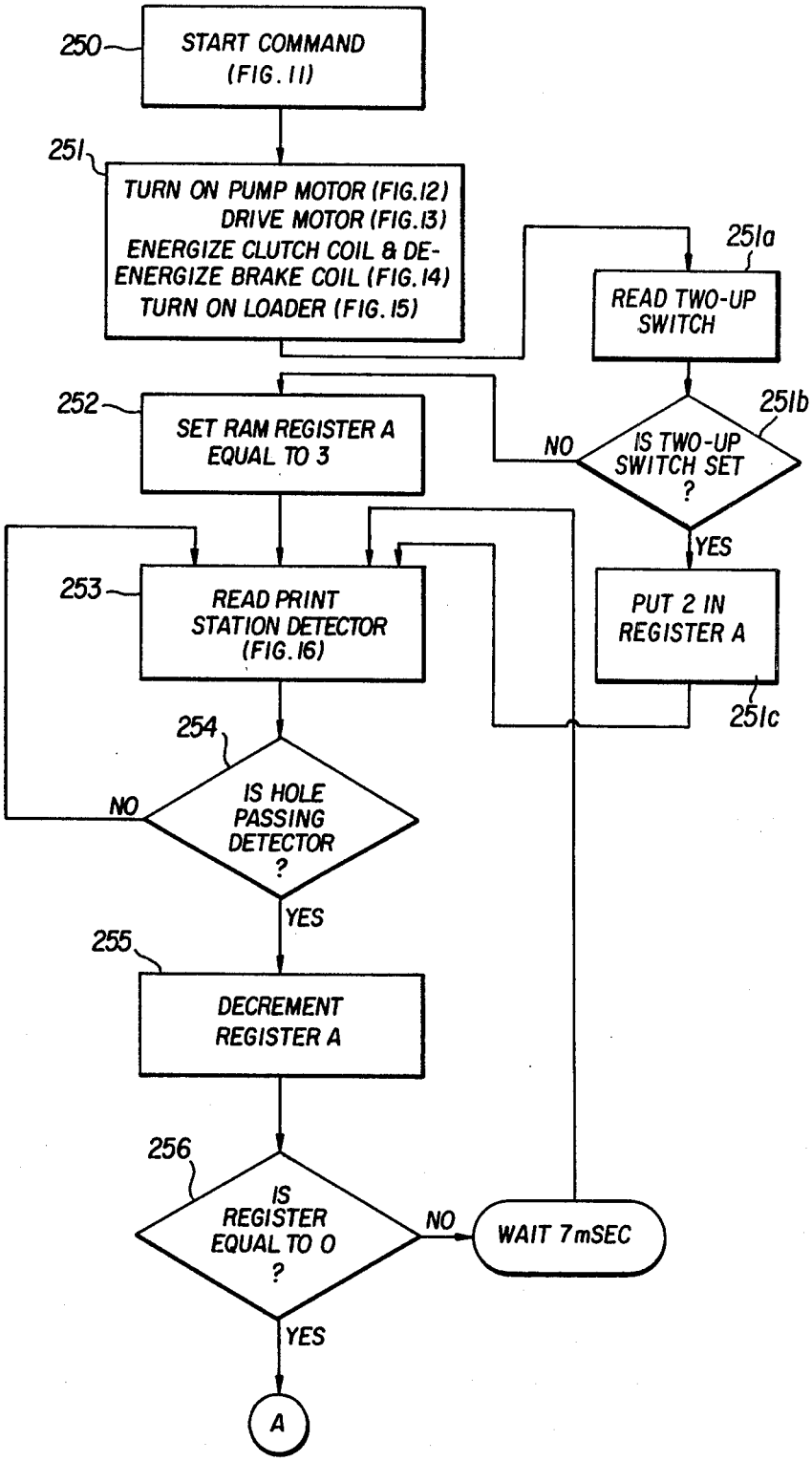
FIGS. 10A–10E comprise a flow chart setting forth the manner in which the microprocessing system is programmed for carrying out successive printing cycles and testing operations.
Figure 11:
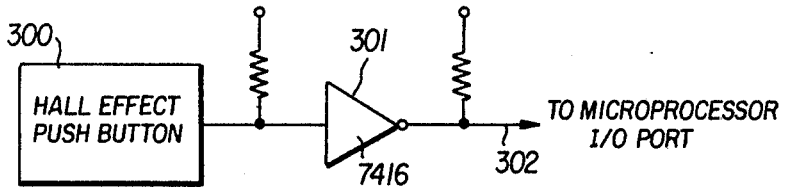
FIGS. 11–22 are detailed schematic diagrams of the electronic circuitry used for interfacing with the microprocessor and for manually adjusting the operation of the printing system.

Printing is commenced by signalling the microprocessor with a start command, represented by block 250 in FIG. 10A. Referring to FIG. 11, the start command is originated by a Hall effect push button 300 on the control panel and is applied to inverting driver 301 in order to produce a clean signal at output 302 that is usable as an input to the microprocessor. A foot switch may be paralleled with the Hall effect push button for more convenient actuation by the operator of the system.

At this point, it should be noted that the part numbers with which the major components of the circuits of FIGS. 11–22 are labelled are standard in the industry and are sufficient to specifically identify the necessary components to those knowledgeable in electronics. The operation and power supply requirements of these components are well known and accordingly do not require detailed discussion.

Figure 12:
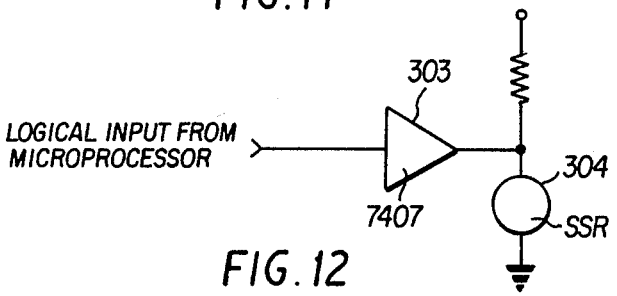
Figure 13:
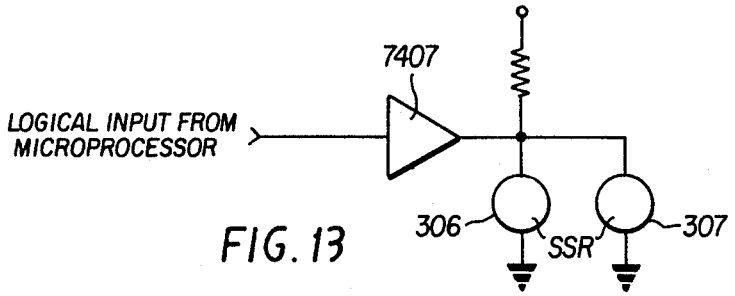
Figures 14, 15:
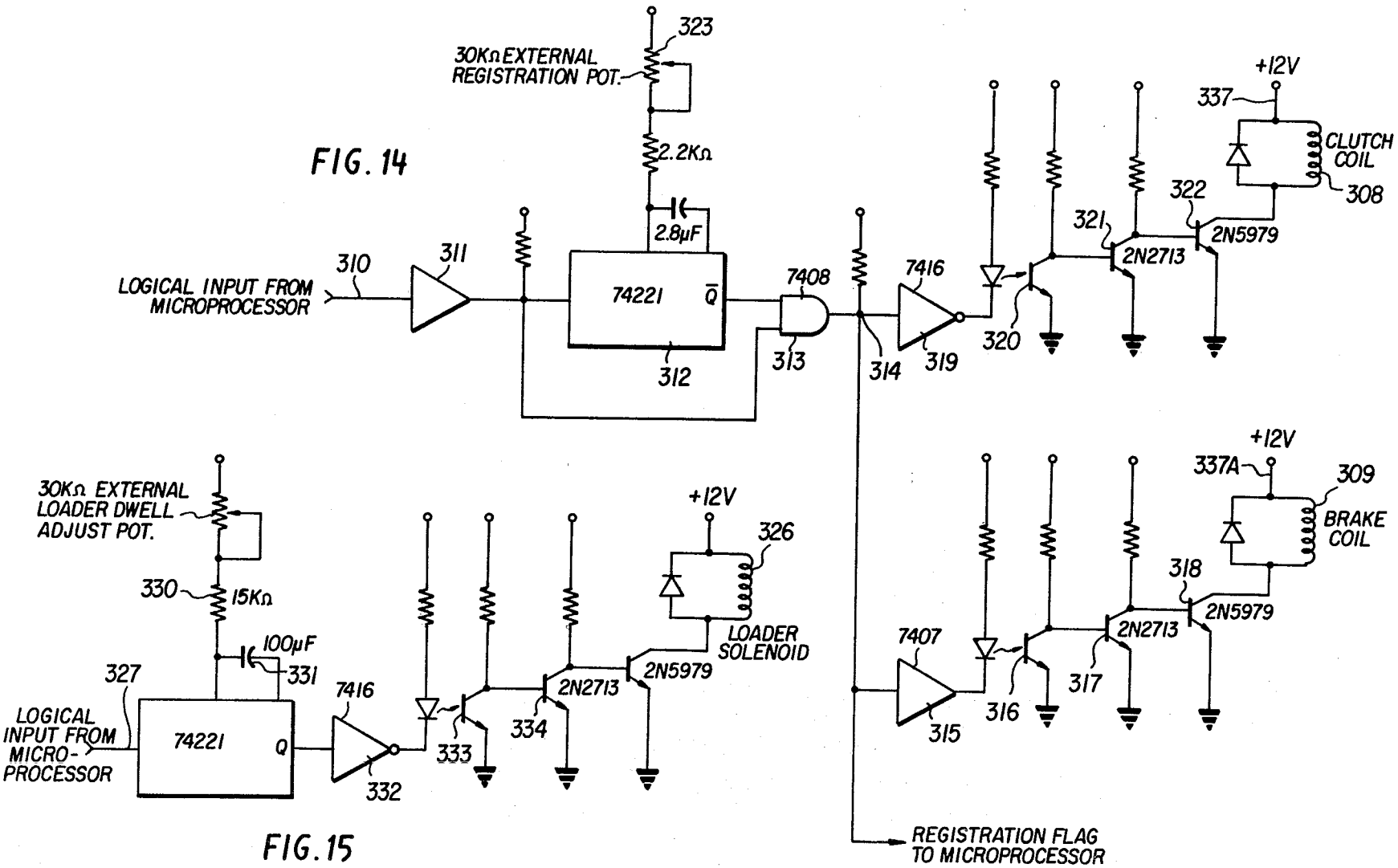

Moving now to block 251, the microprocessor responds to the start command by providing stable positive logic levels to the inputs of the circuits of FIGS. 12, 13, and 14 and a positive pulse to the input of the circuit of FIG. 15. The circuit of FIG. 12 applies the microprocessor output to noninverting driver 303 in order to actuate solid state relay 304, which in turn supplies A.C. power to the motor that drives the vacuum pump used for providing vacuum to the belt-controlling clutch and brake unit 176 (FIG. 6) and the offset roll linear actuator (FIG. 3). The circuit of FIG. 13 employs a similar driver 305 to energize solid state relays 306 and 307 in response to the logical input level from the microprocessor. Relays 306 and 307 in turn switch two legs of a three-phase A.C. motor which supplies driving torque to a gear reducer (together forming unit 158 in FIG. 6) and thence to endless belt 25 (through clutch and brake unit 176), offset roll 35, die roll 130, inking roll 135 and reservoir roll 145.

The circuit of FIG. 14 is used to alternately energize the clutch and brake coils 308 and 309, respectively, of the vacuum-operated clutch and brake unit 176 (FIG. 6) that controls the motion of endless belt 25 in the desired intermittent manner. With a low logic level from the microprocessor applied to the input 310, a low level is produced at node 314 by the combination of noninverting driver, inverting-output one-shot multivibrator 312, and AND gate 313, connected as shown. Tracing this low level through noninverting driver 315, opto-isolator 316, inverting transistor 317, and driver transistor 318, it is apparent that transistor 318 is on and consequently current from the 12-volt source 337A is passing through brake coil 309 in order to maintain the belt motionless. By similarly tracing the zero potential at node 314 through inverting driver 319, opto-isolator 320, inverting transistor 321, and driver transistor 322, it is seen that transistor 322 is off, thus maintaining the clutch coil in a deenergized condition and decoupling the driving torque produced by the A.C. drive motor from the endless belt 25 (FIG. 6). When, as in response to the start command presently being considered, a positive logic level is produced by the microprocessor and applied at the input 310, the output of one-shot 312 goes low and remains low for a period determined by the adjusted value of 30 K-ohm potentiometer 323 in combination with fixed resistor 324 and capacitor 325, which have the values indicated. At the end of this delay period, which corresponds to the registration delay referred to earlier, AND gate 313 receives two positive input and node 314 goes high. When this occurs, the brake coil 309 is deenergized and the clutch coil 308 is energized by the 12-volt source 337, with the result that the endless belt 25 begins to move. A high level at node 314 also serves as a flag for the microprocessor denoting that the registration delay is over. Opto-isolators 316 and 320 insure that switching transients in the 12-volt coil energizing circuitry are not reflected back to the TTL logic circuitry.

Potentiometer 323 is physically mounted on control panel 15 (FIG. 1) of the printing system for convenient adjustment of the registration delay.

It should be noted that belt 25 will continue to move for as long as a high level is applied by the microprocessor to the input 310. When input 310 goes low, node 314 immediately goes low as well, and the belt is abruptly stopped; no time delay is involved.

The last circuit to be activated in block 251 of FIG. 10A is the article loader actuating circuit of FIG. 15. This is shown merely for completeness, the loader forming no part of the present invention. For strip-type articles such as the interconnected electrical components depicted in FIG. 2, the loader will typically include a solenoid-operated arm which presses a new strip of components onto the article-loading end 40 of the endless belt 25 until the strip engages the alignment pins 115. The alignment pins then propel the strip toward the printing nip 30 as described previously. In FIG. 15, the loader arm solenoid is represented by coil 326. In response to the start command, the microprocessor applies a short positive pulse to the input 327, causing the output of noninverting one-shot 328 to go high for an interval determined by the adjusted value of 30 K-ohm potentiometer 329 in combination with fixed resistor 330 and capacitor 331, which have the values indicated. Tracing the one-shot output through inverting driver 332, opto-isolator 333, inverting transistor 334, and driver transistor 335, it will be seen that loader solenoid 326 is energized by 12-volt source 336 during the time interval during which the output of one-shot 328 remains high. This interval, referred to as the loader dwell period, is non-critical and may be adjusted by means of potentiometer 329, which is physically accessible at the control panel 15 (FIG. 1) of the printing system. As before, the function of opto-isolator 333 is to prevent 12-volt power from being imposed on the logic level supply in the event of an output transistor collector-base short.

After the turning on of the loader of FIG. 15, the microprocessor proceeds to read the two-up switch as indicated by block **251*a*, and then proceeds to a decision point indicated by diamond 251*b* where a determination is made if the two-up switch is set. If the two-up switch is not set, the microprocessor proceeds to block 252. If the two-up switch is set, the microprocessor proceeds to block 251*c* where a 2 is placed in register A, and the microprocessor proceeds to block 253** which is described below.

Referring now to block 252 of the flow chart of FIG. 10A, the next operation executed by the microprocessor is to initialize an internal RAM register A with the value 3. As will be seen, this is for the purpose of causing the system to ignore the first two perforations sensed by the print station photoelectric detector, which will be the load-station perforations.

Figure 16:
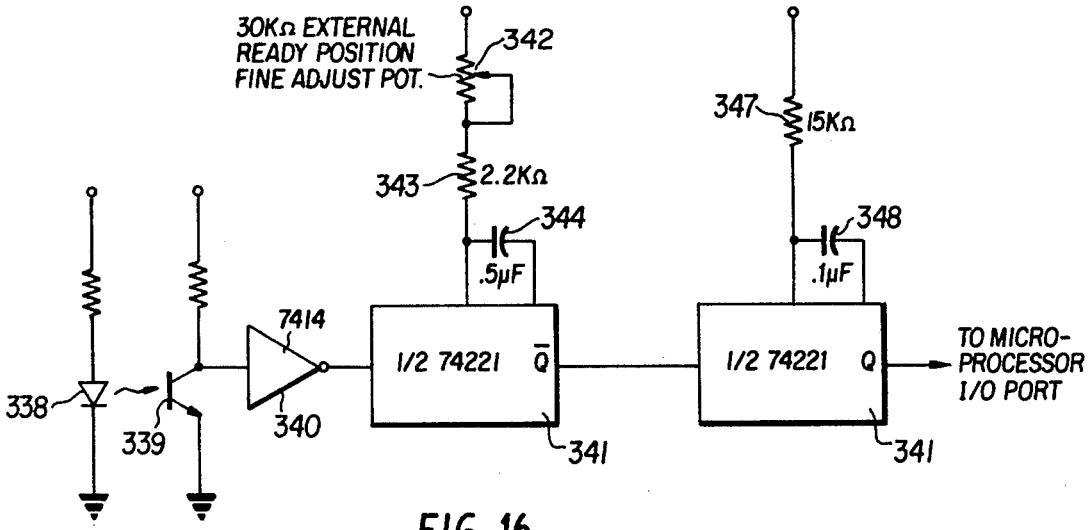
Figure 17:
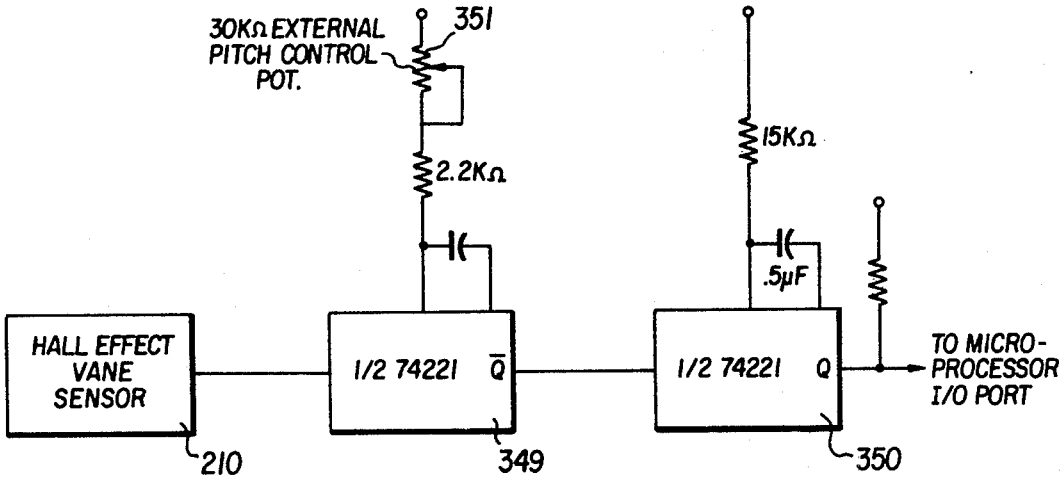

Moving on to block 253, the microprocessor next reads the print station detector in order to determine if a belt perforation is being sensed thereby. This is accomplished by means of the circuitry of FIG. 16, wherein light-emitting diode (LED) 338 and phototransistor 339 comprise the print station detector 121 of FIG. 8. When a belt perforation passes between LED 338 and phototransistor 339, the input to inverting driver 340 goes low and the input of inverting one-shot 341 is brought high. The output of one-shot 341 then goes low for an interval determined by the adjusted value of 30 K-ohm potentiometer 342 in combination with fixed resistor 343 and capacitor 344, which have the values indicated. When this delay period is over, the positive transition of the output of one-shot 341 causes noninverting one-shot 345 to produce an output pulse at terminal 346, whose duration is determined by the indicated values of fixed resistor 347 and capacitor 348 (the notation "½" on one-shots 341 and 345 merely refers to the fact that both circuits are typically found on a single integrated chip). Terminal 346 in turn provides the microprocessor with an indication of whether a belt perforation has arrived at the print station detector. It will be observed that the net result of the circuitry of FIG. 16 is to delay the appearance of an output on terminal 346 with respect to the actual detection of a belt perforation by LED 338 and phototransistor 339. When print-stop perforations are being sensed, this will provide the delay period between the sensing of such a perforation and the microprocessor-initiated stopping of the article-carrying endless belt, and will therefore establish the previously-described rest or "ready" position of the article in advance of the printing nip 30 (FIG. 1). By adjusting potentiometer 342 and thereby varying the delay period, the ready position can be moved as desired with respect to the printing nip 30. Since this is not a frequently-made adjustment, potentiometer 342 is made accessible at a location other than control panel 15 (FIG. 1), such as beneath the forward portion of feed table 100, so that it is less susceptible to inadvertent tampering.

Referring now to block 254 of the flow chart of FIG. 10A, the microprocessor tests for a perforation at the print station detector and, if none is found, repeatedly loops back through blocks 253 and 254 until a perforation is finally sensed. Register A is then decremented by one in block 255, and the register is tested for a zero content in block 256. This test will first produce a negative result, denoting that the perforation just sensed is the first of the two initial load station perforations, which are to be ignored at the print station detector. Accordingly, after an interval software timer generated delay period sufficient to avoid reading the same perforation twice (7 milliseconds in the preferred embodiment), the microprocessor loops back to blocks 253 and 254 to test for a second perforation. When the second load station perforation is encountered and register A is again decremented and tested, its contents will again be found to be nonzero in block 256. After waiting a further 7 milliseconds, the microprocessor will again loop back to blocks 253 and 254 to seek a third perforation at the print station detector. When it is encountered, register A when decremented will contain zero, indicating that the first print-stop perforation has arrived at the print station detector. The microprocessor will then cause the logic level at the input 310 of the circuit of FIG. 14 to transition from high to low, resulting in immediate stopping of the endless belt through deenergization of clutch coil 308 and energization of brake coil 309 as indicated in block 257 of FIG. 10B. It will be recalled that the print station detector circuit of FIG. 16 actually introduces a variable delay period between the occurrence of a print-stop perforation at the detector and the transmission of an indication thereof to the microprocessor. As noted previously, this works to delay the stopping of the belt by the microprocessor and thereby to set the location of the ready position of the article to be printed.

Figure 18:
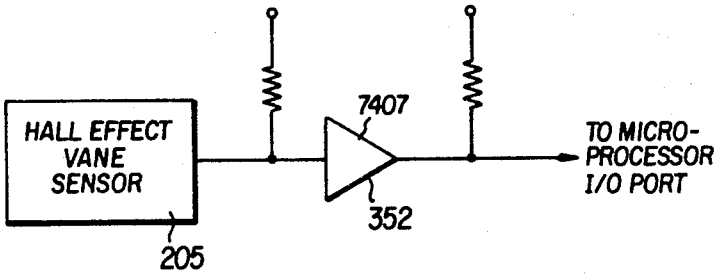

Proceeding to blocks 258 and 259 of FIG. 10B, the microprocessor next tests repeatedly for the alignment of iron vane 215 (FIG. 7) with Hall effect switch 210, which would indicate that a printed image on the offset roll has rotated to a position of predicted registration with the article below. The signal from Hall switch 210 is transmitted to the microprocessor through the circuitry of FIG. 17, which includes one-shots 349 and 350 cascaded in a manner similar to those of FIG. 16 in order to delay the appearance of the signal at the microprocessor input. This delay period, which is adjustable by means of panel-mounted potentiometer 351, is intended to work in connection with assymmetrically mounted Hall effect switch 210 in the manner described previously to compensate for non-180° spacing or "pitch" of the printing dies on the die roll by delaying the restarting of the endless belt just prior to a printing operation. During the start-up cycle presently being described, however, a signal from Hall switch 210 merely causes the microprocessor to next seek a signal from Hall effect switch 205, as represented by blocks 260 and 261 in FIG. 10B. As illustrated in FIG. 18, Hall switch 205 interfaces with the microprocessor through a noninverting driver 352, with no time delay circuitry interposed.

As suggested by block 262 in FIG. 10B, a signal from Hall switch 205, indicating that a printed image on the offset roll has rotated to a position of predicted registration with the surface of the article below, will cause the microprocessor to apply a high logic level to the input 310 of the clutch and brake unit actuating circuit of FIG. 14, in order to restart the motion of the endless belt after the registration delay generated by that circuit is over. At this point, the start-up cycle has ended, and the microprocessor has entered a program loop which will sequence the successive printing cycles that are to follow. Testing first for a signal from Hall switch 210 and then for a signal from Hall switch 205 (as has been done in blocks 258–261 of FIG. 10B) assures that the system will not attempt to execute a print cycle simultaneously the detection of the first print-stop perforation. It also provides a convenient reference for determining which printing die is responsible for the printed image deposited on a given article in a strip of articles, since the article corresponding to the first print-stop perforation will always be printed by the die corresponding to Hall switch 205.

Figure 10B:
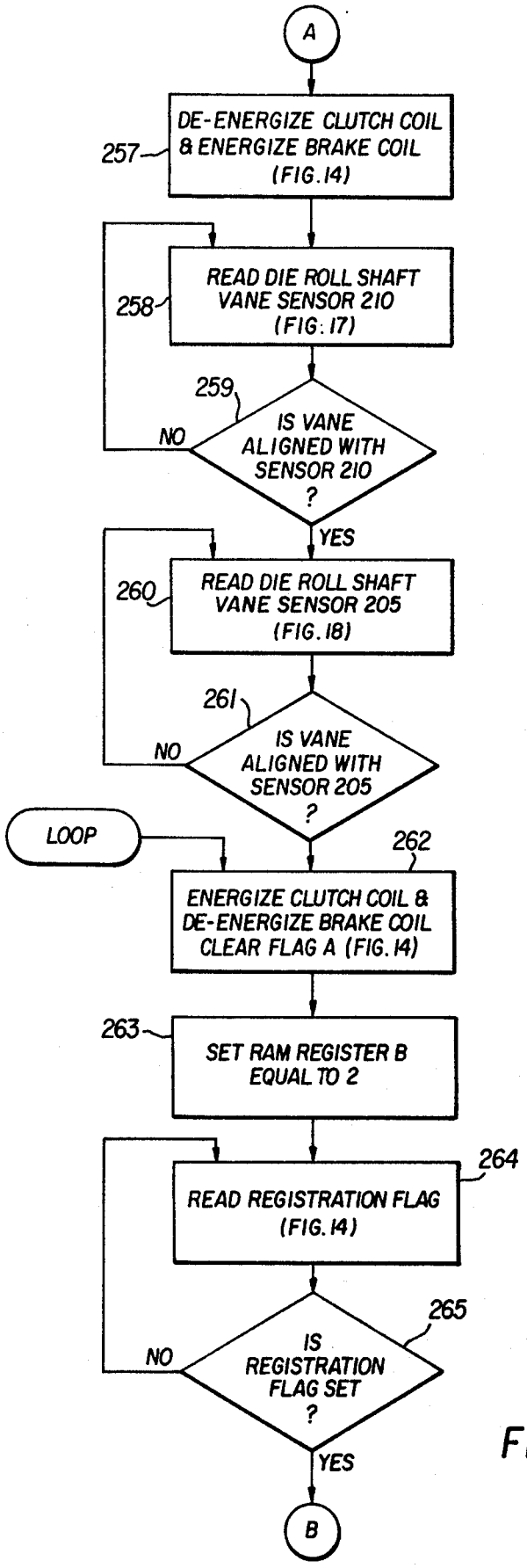

Proceeding to block 263 of FIG. 10B, the microprocessor initializes an internal RAM register B with the value 2. As will be explained in more detail hereinafter, this register is used where the optional two-up mode of operation has been selected.

In blocks 264 and 265, the microprocessor repeatedly tests for a registration flag, that is, for a high level on node 314 in the circuit of FIG. 14. When the flag occurs, indicating that the registration delay is over and the endless belt has begun to move, the microprocessor responds by applying a 0.1 millisecond positive logical pulse to the input 353 of the circuit of FIG. 19 as suggested in block 266 of FIG. 10C. This circuit controls the reciprocation of the offset roll by alternately energizing the up and down valve solenoid coils 354 and 355, respectively, of the vacuum-operated linear actuator 175 (FIG. 3). The circuitry to the right of node 356 is analogous to the corresponding part of FIG. 14, whereby a low level at node 356 will energize down coil 354 and deenergize up coil 355 in order to lower the offset roll to its article printing position, whereas a high level at node 356 will deenergize down coil 355 and energize up coil 354 and thereby restore the offset roll to its upper retracted position. As before, opto-isolators 362 and 363 are used to isolate the logic circuitry from switching transients arising in the 12-volt coil circuits.

Figure 19:
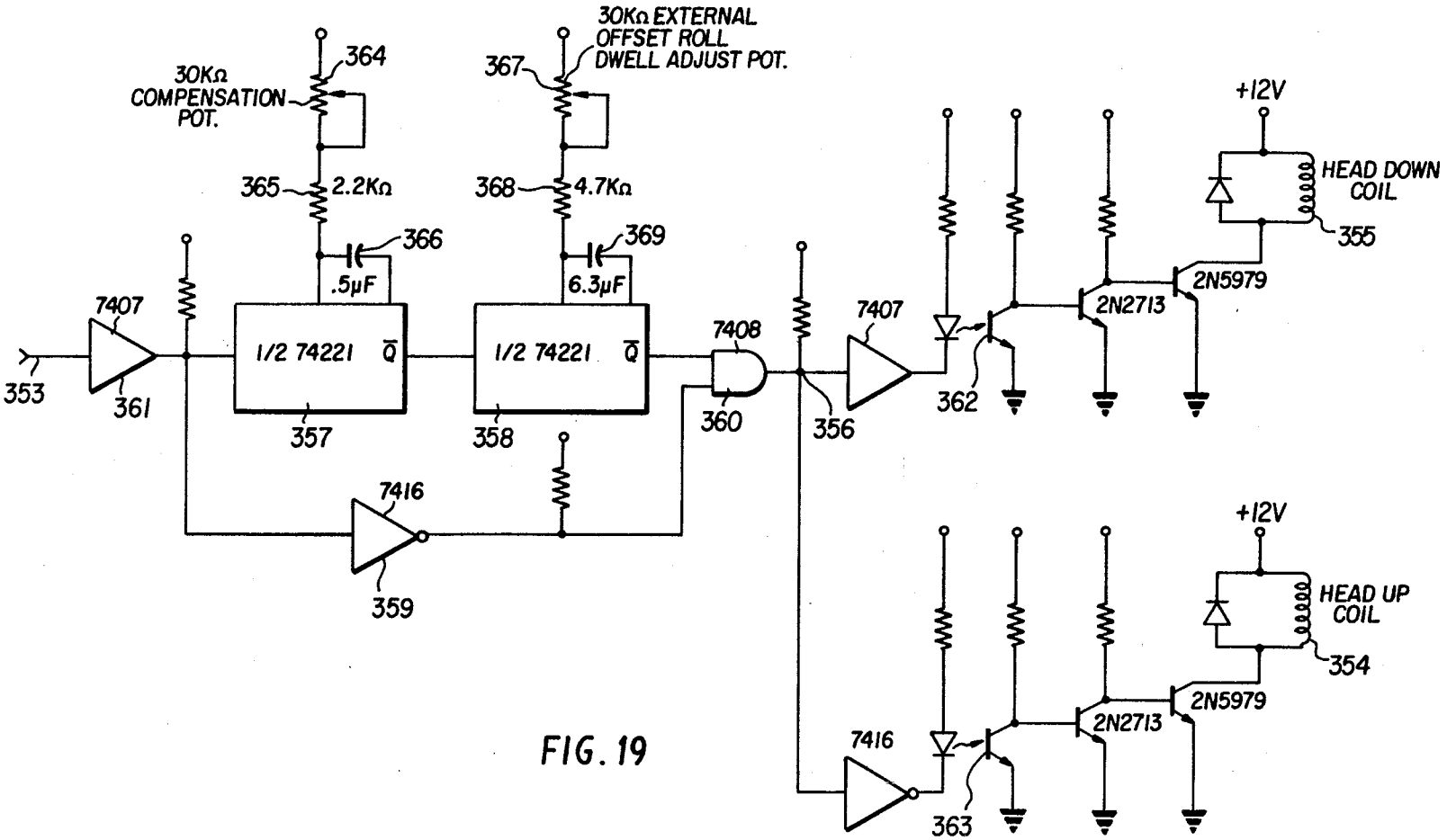

Before a pulse is applied to the input 353 of FIG. 19, the output of inverting one-shot 358 is high and the output of inverting driver 359 is also high. AND gate 360 accordingly maintains a high level on node 356, thereby causing the offset roll to remain in its upper retracted position. When input 353 is pulsed by the microprocessor in response to its detection of the registration flag (FIG. 14), noninverting driver 361 applies a positive pulse to the input of inverting one-shot 357. One-shot 357 responds by causing its output to go low for an interval determined by the adjusted setting of 30 K-ohm potentiometer 364 in combination with fixed resistor 365 and capacitor 366, which have the values shown. At the end of this interval, the positive transition of the output of one-shot 357 causes the output of inverting one-shot 358 to go low and remain low for an interval determined by the adjusted setting of 30 K-ohm potentiometer 367 in combination with fixed resistor 368 and capacitor 369, which have the values indicated. During this interval, AND gate 360 will maintain a low level on node 356 and consequently the offset roll will be displaced to its lower or article printing position. The dwell time of the offset roll in this position may be varied by adjusting potentiometer 367, which is mounted for convenient access on control panel 15 (FIG. 1). When the dwell period expires, the output of one-shot 358 transitions high. By this time, the output of inverting driver 359 has also returned to a high level, since the short input pulse at terminal 353 has long since disappeared. Consequently, AND gate 360 restores a high level to node 356 and the offset roll is returned to its upper retracted position. At this point, the first printing cycle has been completed, and the endless belt continues in motion to propel the next article to be printed toward the printing nip.

It is apparent that potentiometer 364 may be used to adjust the delay period between the appearance of a pulse from the microprocessor at input 353 and the actual lowering of the offset roll to its article printing position by the vacuum-operated linear actuator. Since linear actuators vary in terms of their response time, even as among different actuators of the same model and manufacturer, compensating potentiometer 364 provides a means for delaying the input signal to the actuator for a period of time sufficient to insure that the endless belt is up to speed by the time the offset roll reaches its fully lowered position.

Figure 22:
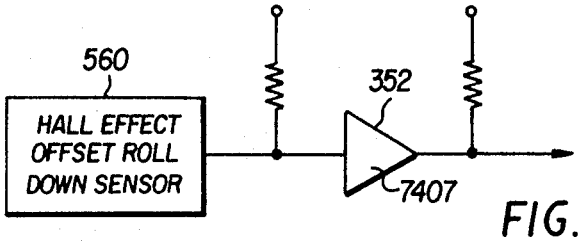

It has been found empirically that, based on a belt speed of about 12 inches per second, the offset roll should reach its fully lowered position during a 5-millisecond window beginning 18 milliseconds after a pulse is applied to the input 353 of the circuit shown in FIG. 19. To test for this condition, the linkage between the offset roll shaft and the linear actuator (FIG. 3) is provided with a Hall effect sensing arrangement (not shown) which produces an output signal when the offset roll is fully lowered. As depicted in FIG. 22, a noninverting driver 370 is used to interface this Hall effect sensor 560 with the microprocessor input. Referring now to the block diagram of FIG. 10C, following block 266 the microprocessor executes a routine (blocks 267–273) for determining whether the offset roll becomes fully lowered within the desired time window. Software timers 267 and 270 are used to measure off the required 18-millisecond and 5-millisecond intervals, respectively. If the offset roll is either found to be fully lowered at the end of the 18-millisecond interval (early response), or is found not to be fully lowered 5 milliseconds later (late response), a control panel lamp labelled "ACTUATOR TIME" (FIG. 9) is turned on to indicate that compensating potentiometer 364 (FIG. 19) requires adjustment.

Figure 10C:
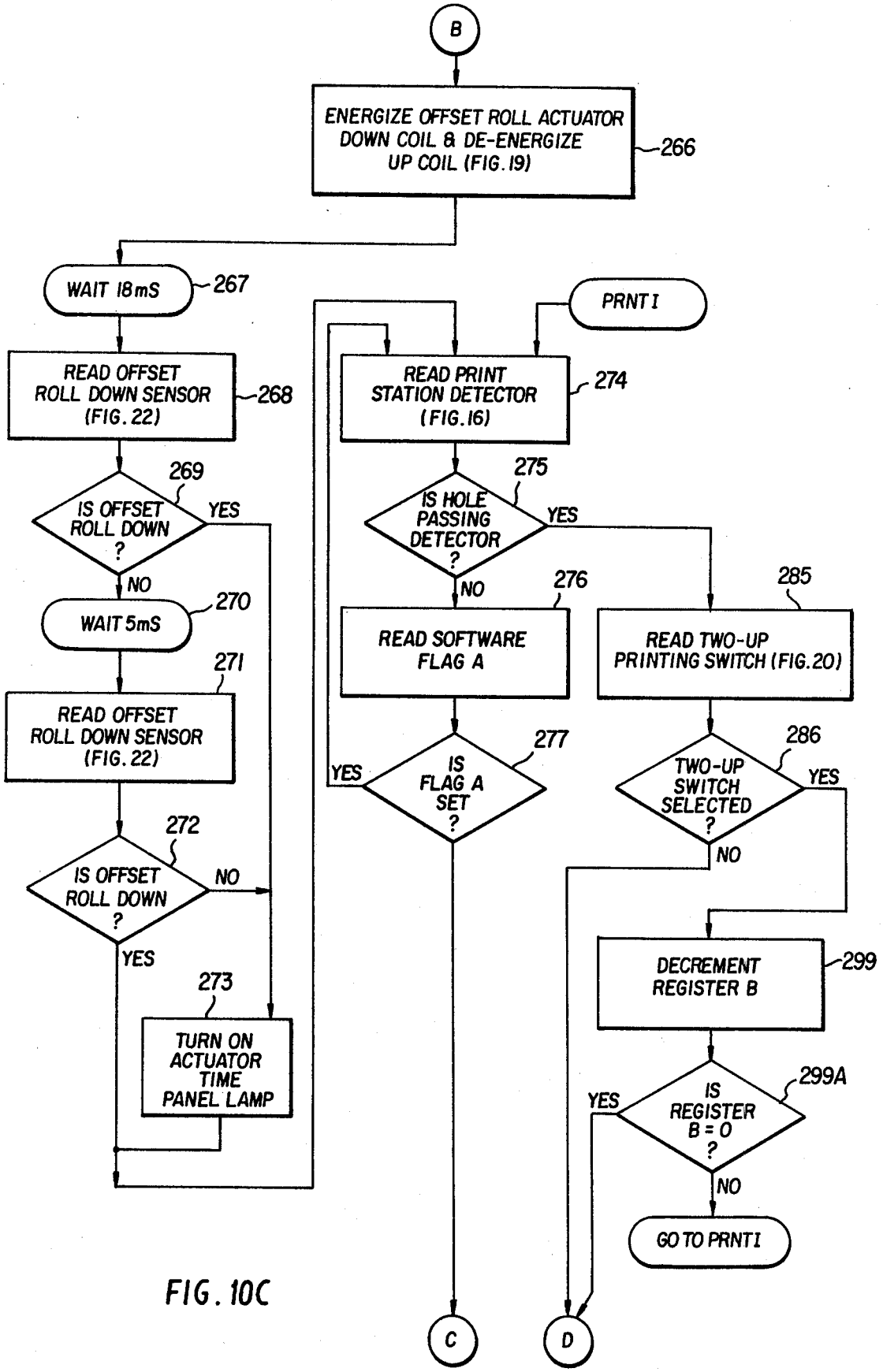
Figure 10D:
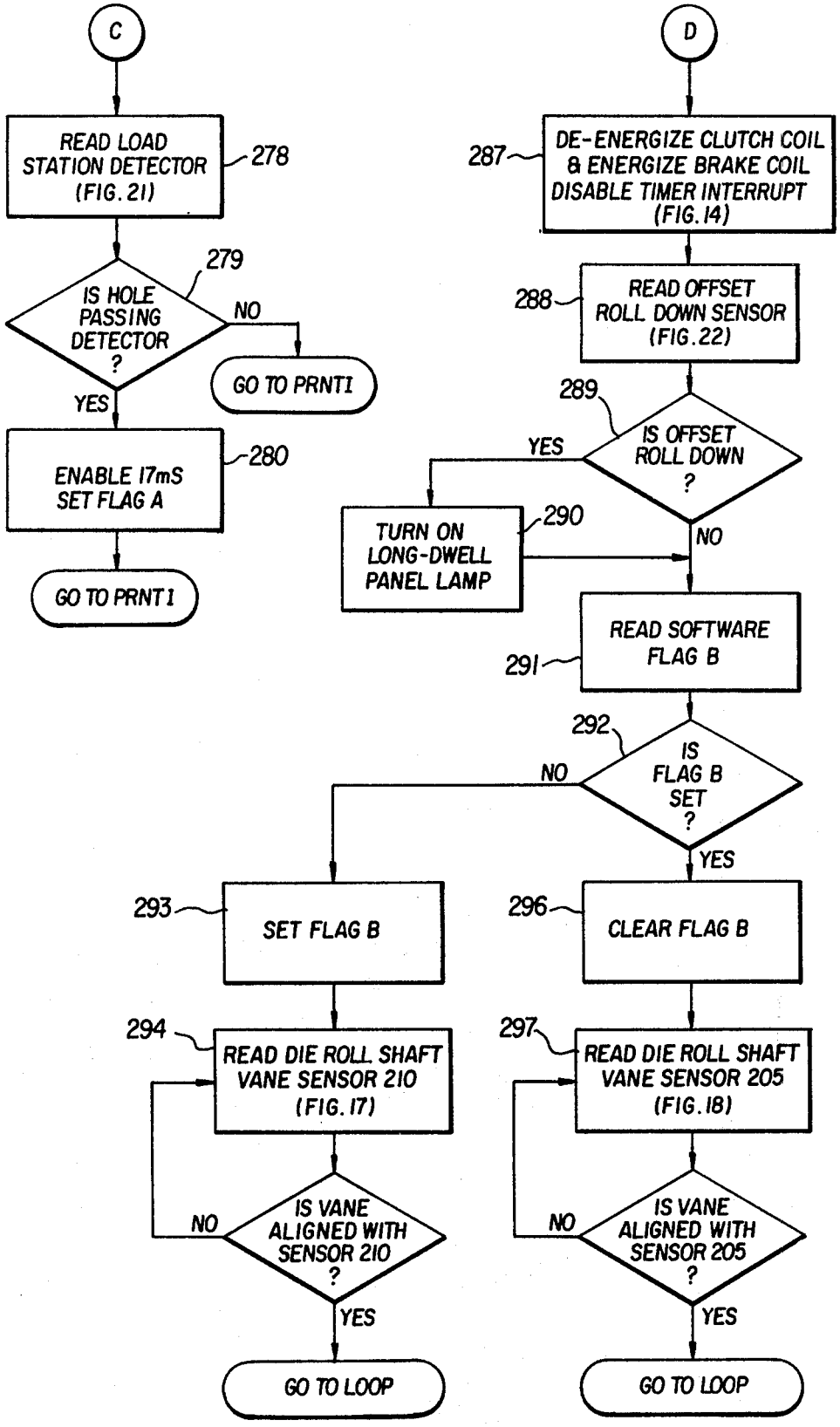
Figure 21:
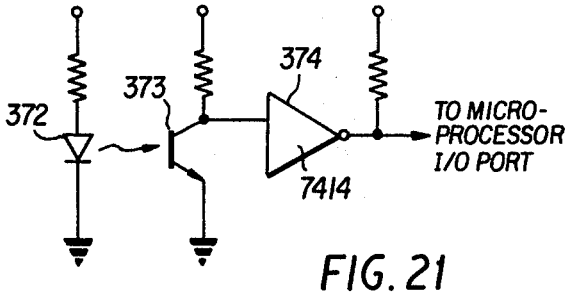

Following the completion of this testing routine, the microprocessor enters a subloop designated PRNTI and tests for the presence of a subsequent belt perforation at the print station detector, as indicated by blocks 274 and 275 in FIG. 10C. If none is found and a software flag A (whose function will shortly become apparent) is found not to be set in blocks 276 and 277, the microprocessor will proceed to blocks 278 and 279 (FIG. 10D) and will test for the presence of a perforation at the load station detector. Referring to FIG. 21, the load station detector is seen to comprise LED 372, cooperating phototransistor 373 (together comprising the load station detector 123 of FIG. 8) and an inverting driver 374 for transmitting a signal representative of a detected perforation to the microprocessor. If no perforation is found at the load station detector, the microprocessor reenters the PRNTI subloop (FIG. 10C) and checks again for a perforation at the print station detector. If a perforation had been found at the load station detector, it might possibly be the first of a pair of load station perforations which together would call for the printing system to halt in preparation for a reloading operation. In the preferred embodiment of the present system, the characteristic spacing between load station perforations is 0.160 inch, which corresponds to a 17-millisecond interval between their detection times at the load station detector based on the known fixed speed of the endless belt.

Accordingly, the detection of a first perforation at the load station detector causes the microprocessor to enable a 17-millisecond software timer and set the software flag A (block 280). The microprocessor will then reenter the PRNTI subloop (FIG. 10C), but will not again test for a belt perforation at the load station detector since the set condition of flag A prevents this. When the 17-millisecond software timer runs out, which may occur when the microprocessor is at any point in the program, the microprocessor diverts unconditionally to the interrupt routine set forth in FIG. 10E. Upon entering this routine, the software flag A is cleared (block 281), and the load station detector is tested for the presence of a second perforation (blocks 282 and 283). If none is present, the microprocessor exits from the interrupt routine and returns to the point in the main program where the interruption occurred. If a second perforation is sensed at the load station detector, however, this signifies that a characteristically spaced pair of load station perforations has been found, and the system is stopped as specified in block 284 by removing A.C. power from the drive motors, energizing the brake, and bringing the article-carrying endless belt to a halt. (A stop command may also be applied manually by means of a panel push button (FIG. 9) that interfaces with the microprocessor in a manner similar to the start push button 300 of FIG. 11.) After a new strip of articles has been loaded onto the endless belt, a new start command may be applied (block 250 in FIG. 10A) in order to initiate a further series of printing cycles.

Figure 20:
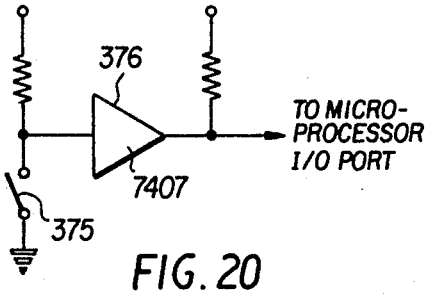

Referring back to FIG. 10C and assuming now that a perforation had been detected at the print station detector (block 275), the microprocessor would then test the two-up printing switch in order to determine whether the two-up mode of operation, described previously, had been selected (blocks 285 and 286). Referring to FIG. 20, the state of two-up switch 375 (which is included among the set-up switches shown in FIG. 9) is sensed by noninverting driver 376 in order to provide an input to the microprocessor. If the two-up switch is found not to be selected, the endless belt is stopped in preparation for another printing operation by bringing the input of the circuit of FIG. 14 low (block 287 in FIG. 10D). At this point, the offset roll down sensor of FIG. 22 is tested to determine if the offset roll is still in its fully lowered position as a result of the previous printing cycle (blocks 288 and 289). If it is, the offset roll dwell is set too long and a panel lamp labelled "LONG DWELL" (FIG. 9) is turned on (block 290) to indicate that potentiometer 367 in the circuit of FIG. 19 requires adjustment. In any case, the processor proceeds to blocks 291 and 292, where the set condition of a software flag B is tested in order to determine which of the die roll Hall effect switches of FIG. 7 will produce the next print. If flag B is not set, it is immediately set (block 293), and the microprocessor then proceeds to repeatedly test for an output from the Hall switch 210 (blocks 294 and 295). When a signal is finally produced by the switch 210, indicating that an image deposited on the offset roll by the corresponding printing die has rotated to a position of predicted registration with the motionless article below, the microprocessor loops back to block 262 (FIG. 10B) and transfers the printed image to the waiting article by restarting the belt and then lowering the offset roll for the preset dwell period after the registration delay has expired. On its next pass through blocks 291 and 292 (FIG. 10D), the microprocessor will find flag B to be set, indicating that the next article is to be printed with the image deposited on the offset roll by Hall switch 205 of FIG. 7. Flag B is then cleared (block 296), and the processor proceeds to repeatedly test for a signal from switch 205. When it occurs, the microprocessor loops back to block 262 (FIG. 10B) as before and initiates the printing of the next article. It is apparent that the cyclical setting and clearing of software flag B will insure that printing is accomplished in an alternating manner by the two printing dies associated with Hall effect switches 210 and 205. Consequently, two articles are printed for each revolution of the die roll and offset roll.

A slight modification occurs in the program sequence when the microprocessor determines that the two-up switch has been selected (blocks 285 and 286 in FIG. 10C) after it has found a print-stop perforation at the print station detector (block 275). It will be recalled that for this mode of operation, four printing dies are secured on the die roll rather than two. In such a case, the RAM register B (which was initially set equal to 2 in block 263) is decremented by 1 (box 299) and then tested for a zero content (box 299A). On the first pass, a zero content will not be found, and the processor will reenter the PRNTI subloop at block 274 and await the arrival of the next print-stop perforation at the print station detector, thereby effectively ignoring the preceding print-stop perforation. Thus, the endless belt continues to move and propels two articles in sequence through the printing nip. Assuming that the offset roll dwell time has been adjusted to be sufficiently long, images deposited on the offset roll by the first pair of printing dies will be transferred to these two articles in sequence while the offset roll remains in its lowered position. On the second pass of the processor through program blocks 299 and 299A, register B will be decremented to zero and the endless belt will then be stopped (block 287) in preparation for the printing of the next two articles with the images deposited on the offset roll by the second pair of printing dies.

Referring again to the block diagram of FIG. 9, the function of certain auxiliary panel controls, although not essential to an understanding of the present invention, will now be briefly described.

Activation of the control labelled "HEAD JOG" causes the print head (i.e., the offset, die, inking and reservoir rolls) to execute a fraction of a revolution or more for cleaning purposes. This control is preferably implemented by a push button that interfaces with the microprocessor in the manner depicted in FIG. 11.

The control labelled "OFFSET ROLL DOWN" is used for maintaining the offset roll in its lowered or article printing position continuously, without reciprocation, from one printing cycle to the next. This is useful in cases where the spacing between successive articles is large enough so that it is not necessary for the offset roll to assume its retracted position after printing a given article to avoid further contact with the trailing edge of that article (or premature contact with the leading edge of the next article) after the belt has stopped in preparation for printing the next article. This control is preferably implemented by a switch similar to that shown in FIG. 20. With reference to the flowchart of FIGS. 10A–10E, the microprocessor tests the condition of this switch at the time of a start command and, if it is found to be selected, lowers the offset roll to its article-printing position applying a continuous input to the circuit of FIG. 19. After entering the printing loop (FIG. 10B), the microprocessor would again test the condition of this switch just before block 266 (FIG. 10C). Assuming the switch has been selected, the microprocessor would then bypass blocks 266 through 273 and immediately enter the PRNTI subloop at block 274.

Figure 10E:
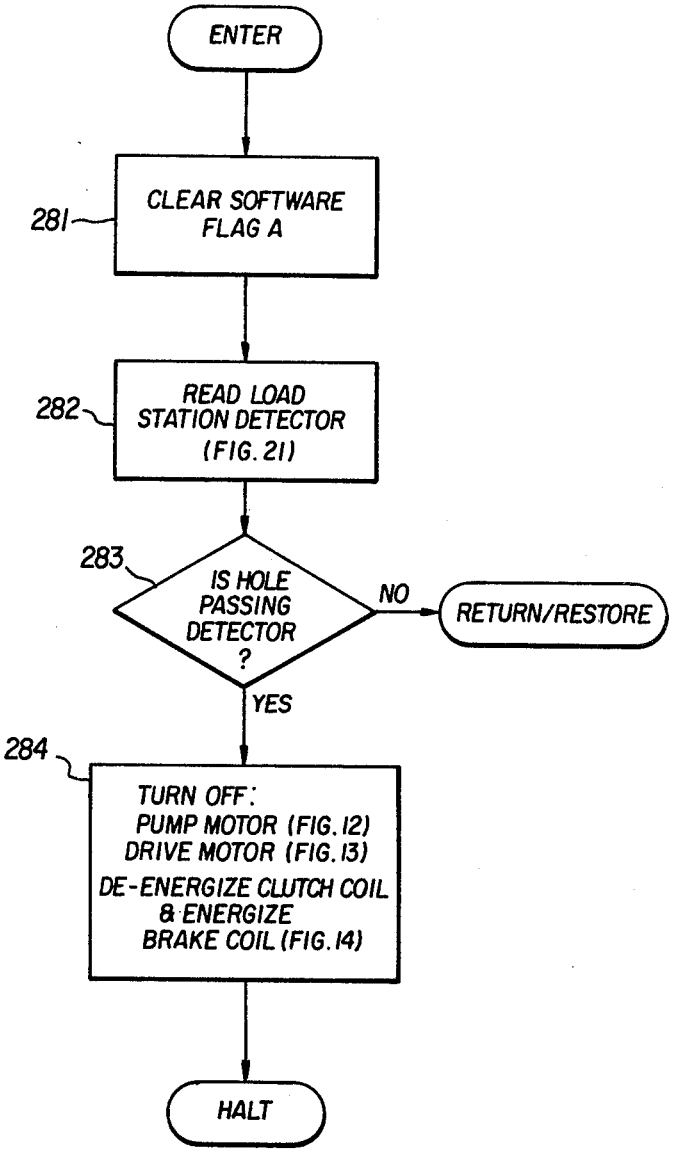

Referring once again to FIG. 9, a control labelled "HEAD CONTINUOUS" is provided to selectively inhibit the stopping of print head rotation (that is, the rotation of the offset, die, inking and reservoir rolls) that normally occurs when the detection of a pair of load station perforations indicates that a complete strip of articles has been printed. With reference to FIG. 10E, this is accomplished by omitting the drive motor power-off stop from block 284. This option is useful when successive strips are loaded quickly enough (such as by automatic equipment) so that excessive ink accumulations on the print head rolls does not occur between strips. The "HEAD CONTINUOUS" control preferably takes the form of a switch interfacing with the microprocessor analogously to FIG. 20.

The set-up switch labelled "50 HZ–60 HZ" in FIG. 9, also similar to that shown in FIG. 20, is set according to the A.C. supply frequency used to power the printing system. The power supply frequency will affect the speed of the A.C. drive motor and hence the linear speed at which the article-carrying endless belt is moved. The state of the "50 HZ–60 HZ" switch is therefore tested by the microprocessor to compensate the various software timers of FIGS. 10A–10E accordingly. The panel switch labelled "VACUUM PUMP" is a single-throw switch for controlling the A.C. power to the vacuum pump motor through microprocessor control.

The remaining switches and indicator lamps shown in FIG. 9 relate to the operation of the article loading and ultraviolet curing apparatus, which form no part of the present invention.

Figure 23:
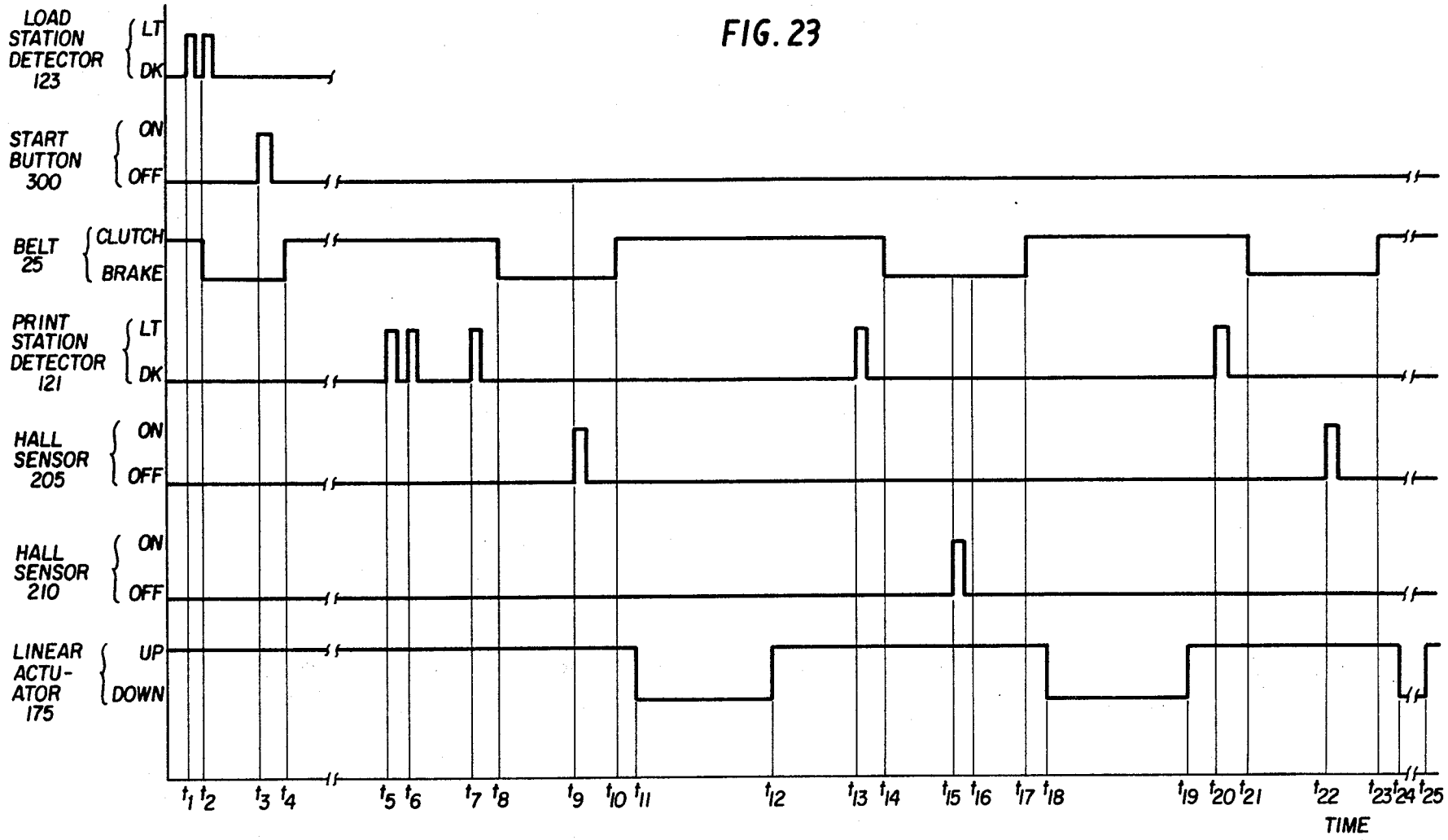
FIG. 23 is a timing diagram summarizing the progress of several successive printing cycles.

FIG. 23 is a timing diagram which, although not drawn to scale, summarizes the sequence of operations that occur in the course of several successive printing cycles. Assuming for convenience that the last article on a strip of interconnected articles has just been printed, a new pair of load station perforations denoting a new strip-receiving segment of the endless belt will be approaching the load station photoelectric detector. The two load station perforations pass the load station detector at times $t_1$ and $t_2$, respectively, which are represented on the uppermost line of the timing diagram as two successive transitions of the load station detector from a "dark" (DK) condition to a "light" (LT) condition. The characteristic interval ($t_2$–$t_1$) between detection of the two load station perforations is interpreted by the system as a halt command which results in the stopping of the endless belt at time $t_2$ by deenergization of the clutch coil of the vacuum-activated clutch and brake unit, and simultaneous energization of the brake coil.

At time $t_3$, a manual start command is applied by the operator of the system. As noted previously, this may also initiate semiautomatic loading of a new strip of articles onto the next strip-receiving segment of the endless belt by means of a solenoid-actuated loader arm or the like. At time $t_4$, the belt is placed into motion and begins to convey the new strip of articles toward the printing nip. The delay interval ($t_4$–$t_3$) is the registration delay (which is of no consequence at this point) and is determined by the setting of potentiometer 323 in FIG. 14 as described previously.

Shortly after the belt begins moving, print-stop perforations will begin passing the load station detector. However, since these perforations do not have the characteristic spacing that distinguishes load station perforations, they are ignored at the load station detector and have no effect on the system. In the interest of simplicity, therefore, the detection of these perforations by the load station detector has been omitted from FIG. 23.

Some time later, when the new strip of articles has nearly reached the printing nip, the two load station perforations are sensed by the print station detector as represented by points $t_5$ and $t_6$. Since these are the first two perforations to reach the print station detector after the occurrence of the start command, they are ignored by the system and the belt continues in motion. At time $t_7$, the first print-stop perforation aligns with the print station detector and is recognized as such. There follows a delay interval whose duration is determined by the setting of potentiometer 342 in FIG. 16 ("ready" position fine adjustment). When this interval is over, at $t_8$, the first article to be printed is at the ready position and the belt is abruptly halted. Since the print-stop perforation has in effect "overshot" the print station detector in reaching the predetermined ready position, the print station detector has reverted to its dark condition shortly after $t_7$.

With the belt stopped and the first article in the ready position, the system awaits a signal from Hall switch 205 (FIG. 7) indicating that a printed image on the offset roll has rotated to a position of predicted registration with the motionless article surface below. When this occurs at $t_9$, the registration delay is initiated. At $t_{10}$, when the registration delay is over, the belt is accelerated in preparation for printing. At $t_{11}$, after a further delay interval attributable to the compensating potentiometer 364 in FIG. 19, the offset roll is lowered to its article printing position by the linear actuator 175 and brought into rolling contact with the moving article surface for transfer of the printed image thereto. The offset roll remains lowered until $t_{12}$, the dwell interval ($t_{12}$–$t_{11}$) being determined by the setting of potentiometer 367 in FIG. 19. At time $t_{12}$, the offset roll is restored in its upper retracted position to avoid subsequent contact with the trailing edge of the article just printed and premature contact with the leading edge of the next article to be printed.

At $t_{13}$, detection of another print-stop perforation at the print station detector signals that the next article to be printed is approaching the printing nip. At $t_{14}$, after the delay interval ($t_{14}$–$t_{13}$) which establishes the ready position, the belt is stopped and the system awaits a signal from the second Hall switch 210.

At $t_{15}$, a signal is produced by Hall switch 210 (FIG. 7) and two delay periods follow. The first, shown as the interval between $t_{15}$ and $t_{16}$, represents the delay produced by the "pitch" adjusting potentiometer 351 (FIG. 17) to compensate for possible non-180° spacing of the printing dies on the circumference of the die roll. The second delay period, occurring between $t_{16}$ and $t_{17}$, is the registration delay produced by potentiometer 323 (FIG. 14). At $t_{17}$, the endless belt is rapidly accelerated in preparation for printing and, after a further delay period attributable to compensating potentiometer 364 (FIG. 19), the offset roll is lowered at $t_{18}$ to transfer the next image. At $t_{19}$, the offset roll dwell period has expired, the second article has been printed, and the offset roll is restored to its upper retracted position.

At $t_{20}$, a new print-stop perforation is detected by the print station detector and the sequence of events represented by $t_7$ through $t_{12}$ is repeated at $t_{20}$ through $t_{25}$. It is apparent that Hall switches 205 and 210 will initiate alternate image transfers, so that corresponding printing dies 150 and 155 (FIG. 3) will be responsible for printing alternate articles in a given strip. At some point, not shown on the timing diagram of FIG. 23, a characteristically spaced pair of load station perforations will pass the load station detector to indicate that the system is ready to receive a new strip of articles. At this point, the system will halt and await a new start command.

The two-up mode of operation (not shown) is essentially the same as that represented in FIG. 23 except that an additional print-stop perforation would be detected by the print station detector (and ignored) some time after the detection of each of the print-stop perforations shown at $t_7$, $t_{13}$ and $t_{20}$. In this mode of operation, the dwell time of the offset roll is made long enough to enable two successive articles to be printed while the offset roll remains lowered, and two additional printing dies are attached to the die roll. It is obvious that this mode could be carried out with any desired number of articles being printed while the offset roll remains lowered, merely by adding additional printing dies to the die roll and modifying the system programming accordingly.

While a preferred embodiment of a printing system in accordance with the present invention has been described, it is to be understood that the scope of the invention is not restricted to the details thereof. The offset roll, for example, may be arranged to reciprocate in other than an arcuate path centered about the die roll shaft; alternatively, the entire print head may be made to reciprocate. Moreover, although the disclosed embodiment of the invention is of particular utility in printing on interconnected articles in discrete strips such as the dual inline package strips depicted in FIG. 2, it is equally useful for printing on individual articles not in strip form. Further, although a microprocessor has been used as the control means for the disclosed printing system, it is within the scope of the invention to employ other types of control means, electronic or otherwise.

What is claimed is:

1. A rotary offset article printing system comprising:

(a) a die roll having an outside circumference to which is secured a printing die, the die roll being rotatably mounted on a first axis;

(b) means for applying ink to the printing die;

(c) an offset roll having an outside circumference which is positioned for rolling contact with the printing die to transfer from the printing die to the outside circumference of the offset roll printed indicia to be transferred to an article at a printing position, the offset roll being rotatably mounted on a second axis;

(d) means for continuously rotating the die roll and the offset roll respectively about the first and second axes, the linear velocity of the printing die and the linear velocity of the outside circumference of the offset roll being substantially identical;

(e) an article conveying means for carrying articles to be printed, the article conveying means being selectively movable at a linear velocity which is substantially identical to the linear velocity of the outside circumference of the offset roll and selectively stopped, the article conveying means accelerating from a stop to said linear velocity during the conveying of an article to be printed from a rest position to the printing position and moving uniformly at said linear velocity during the transfer of indicia from the offset roll to the article to be printed at the printing position, the rest position being located a predetermined distance from the printing position;

(f) drive means for causing the stopping and selective motion of the article conveying means at said linear velocity; and (g) displacement means for selectively moving the offset roll between first and second positions, the outside circumference of the offset roll being out of contact with the article to be printed when the offset roll is in the first position and the article to be printed is at the rest position and the outside circumference of the offset roll being in rolling contact with the article to be printed when the offset roll is in the second position and the article to be printed isat the printing position.

2. A rotary offset article printing system as recited in claim 1, wherein the first axis is fixed and the second axis is movable along an arcuate path whose center lies on the first axis, said first and second axes remaining at all times substantially parallel, and wherein the end points of said arcuate path establish the first and second positions of the offset roll.

3. A rotary offset article printing system as recited in claim 1 further comprising:

(a) first means for sensing the arrival of an article to be printed, which is carried by the article conveying means, at the rest position of the article and for producing an indication thereof;

(b) second means for sensing the rotation of indicia carried on the outside circumference of the offset roll to a position of predicted registration with the article at the rest position and for producing an indication thereof; and (c) control means responsive to an indication produced by the first sensing means for causing the drive means to stop the article conveying means, and responsive to an indication produced by the second sensing means for causing the drive means to accelerate the article conveying means to said linear velocity and for causing the displacement means to move the offset roll from the first position to the second position.

4. A rotary offset article printing system in accordance with claim 3, wherein said control means comprises a microprocessor.

5. A rotary offset article printing system as recited in claim 3 wherein the means for causing the stopping and selective motion of the article conveying means comprises:

(a) a source of rotary motion selectively coupled to the article conveying means; and (b) a clutch and brake unit for selectively stopping the article conveying means and for selectively coupling the source of rotary motion to the article conveying means to cause the article conveying means to move at said linear velocity.

6. A rotary offset article printing system as recited in claim 5 wherein the article conveying means comprises an endless conveyor belt.

7. A rotary offset article printing system as recited in claim 6 wherein the endless conveyor belt has a series of spaced perforations which establish the rest positions of the articles carried by the belt, and wherein the first sensing means comprises means for detecting the perforations in the endless conveyor belt.

8. A rotary offset article printing system as recited in claim 7 wherein the same for detecting perforations comprises:

(a) a light source located on one side of the endless conveyor belt which produces a light beam which passes through a perforation in the endless conveyor belt when an article being carried by the endless conveyor belt has reached the rest position; and (b) a light sensor located on the opposite side of the endless conveyor belt which intercepts the beam of light passing through the perforation in the endless conveyor belt, the light sensor producing a signal which is coupled to the control means to indicate the presence or absence of a perforation.

9. A rotary offset article printing system as recited in claim 8 wherein the second sensing means comprises a means for sensing a predetermined angular position of the offset roll.

10. A rotary offset article printing system as recited in claim 9 wherein the means for sensing a predetermined angular position of the offset roll comprises a Hall effect sensor cooperating with the die roll.

11. A rotary offset article printing system as recited in claim 3 further comprising means for varying the time interval during which the offset roll remains in the second position.

12. A rotary offset article printing system as recited in claim 3 further comprising first variable time delay means for delaying the acceleration of the article conveying means to said linear velocity, whereby the location on the article at which transfer of printed indicia from the offset roll will occur may be varied.

13. A rotary offset article printing system as recited in claim 12 wherein the first variable time delay means has its input coupled to the control means and its output coupled to the drive means, and wherein the first variable time delay means receives an input signal which is produced by the control means in response to an indication by the second sensing means that a printed image carried in the circumference of the offset roll has rotated to a position of predicted registration with an article at the rest position.

14. A rotary offset article printing system as recited in claim 13 further comprising second variable time delay means for varying the time interval during which the offset roll remains in its second position, said second time delay means having an input coupled to the control means and an output coupled to the displacement means, and wherein the second time delay means receives an input signal produced by the control means in response to a signal produced at the output of the first time delay means indicating that the delay period of the first time delay means has expired and that the article conveying means has been caused to accelerate to said linear velocity.

15. A rotary offset article printing system as recited in claim 14 further comprising third variable time delay means coupled between the output of the control means and the input of the second variable time delay means, whereby the commencement of an output signal to the displacement means from the second variable time delay means in response to an input signal from the control means may be delayed by a time interval sufficient to insure that the article conveying means has reached said linear velocity by the time the displacement means has caused the offset roll to assume its second position.

16. A rotary article printing system as recited in claim 15, wherein the first sensing means includes fourth variable time delay means for delaying the indication produced thereby, whereby the rest position of the article to be printed may be varied.

17. A rotary offset article printing system as recited in claim 16, wherein the second sensing means includes fifth variable time delay means for delaying the indication produced thereby, whereby the angular position of the printing die along the outside circumference of the die roll may be compensated.

18. A rotary offset article printing system in accordance with claim 14 further comprising a second printing die secured to the outside circumference of the die roll at a location circumferentially separated from the location of the first printing die by the linear distance between successive articles to be printed, and wherein the control means is selectively unresponsive to alternate indications produced by the first sensing means, and further wherein the delay period of the second variable time delay means is adjustable to a value of sufficient duration to allow two successive articles to pass the print position while the offset roll remains in its second position, whereby printed images derived from the first and second printing dies may be transferred by the offset roll to the two successive articles, respectively, during the time the offset roll remains in its second position.

19. A rotary offset article printing system in accordance with claim 18 wherein said control means comprises a microprocessor.

20. A rotary offset article printing system comprising:

(a) a die roll having an outside circumference to which is secured a printing die, the die roll being rotatably mounted on a first axis;

(b) means for applying ink to the printing die;

(c) an offset roll having an outside circumference which is positioned for rolling contact with the printing die to transfer from the printing die to the outside circumference of the offset roll printed indicia to be transferred to an article at a printing position, the offset roll being rotatably mounted on a second axis;

(d) means for continuously rotating the die roll and the offset roll respectively about the first and second axes, the linear velocity of the printing die and the linear velocity of the outside circumference of the offset roll being substantially indentical;

(e) an article conveying means for carrying articles to be printed, the article conveying means being selectively movable at a linear velocity which is substantially identical to the linear velocity of the outside circumference of the offset roll during printing and being selectively stoppable, the article conveying means accelerating from a stop to said linear velocity during the conveying of an article to be printed from a rest position to the printing position and moving uniformly at said linear velocity during the transfer of indicia from the offset roll to the article to be printed at the printing position, the rest position being located a predetermined distance from the printing position;

(f) drive means for causing the stopping and selective motion of the article conveying means at said linear velocity;

(g) displacement means for selectively moving the offset roll between first and second positions, the outside circumference of the offset roll being out of contact with the article to be printed when the offset roll is in the first position and the article to be printed is at the rest position, and the outside circumference of the offset roll being in rolling contact with the article to be printed when the offset roll is in the second position and the article to be printed is at the printing position;

(h) first means for sensing the arrival of an article to be printed, which is carried by the article conveying means, at the rest position of the article and for producing an indication thereof;

(i) second means for sensing the rotation of indicia carried on the outside circumference of the offset roll to a position of predicted registration with the article at the rest position and for producing an indication thereof;

(j) control means responsive to an indication produced by the first sensing means for causing the drive means to stop the article conveying means, and responsive to an indication produced by the second sensing means for causing the drive means to accelerate the article conveying means to said linear velocity and for causing the displacement means to move the offset roll from the first position to the second position; and (k) variable time delay means for delaying the response of the control means to the indication produced by the second sensing means to vary the location on the article at which transfer of printed indicia occurs.

21. A rotary offset article printing system as recited in claim 20, wherein the means for causing the stopping and selective motion of the article conveying means comprises:

(a) a source of rotary motion selectively coupled to the article conveying means; and (b) a clutch and brake unit for selectively stopping the article conveying means and for selectively coupling the source of rotary motion to the article conveying means to cause the article conveying means to move at said linear velocity.

22. A rotary offset article printing system as recited in claim 21 wherein the article conveying means comprises an endless conveyor belt.

23. A rotary offset article printing system as recited in claim 22 wherein the endless conveyor belt has a series of spaced perforations which establish the rest positions of the articles carried by the belt, and wherein the first sensing means comprises means for detecting the perforations in the endless conveyor belt.

24. A rotary offset article printing system as recited in claim 23 wherein the means for detecting perforations comprises:

(a) a light source located on one side of the endless conveyor belt which produces a light beam which passes through a perforation in the endless conveyor belt when an article being carried by the endless conveyor belt has reached the rest position; and (b) a light sensor located on the opposite side of the endless conveyor belt which intercepts the beam of light passing through the perforation in the endless conveyor belt, the light sensor producing a signal which is coupled to the control means to indicate the presence or absence of a perforation.

25. A rotary offset article printing system in accordance with claim 24, wherein said control means comprises a microprocessor.

26. A rotary offset article printing system comprising:

(a) a die roll having an outside circumference to which is secured a printing die, the die roll being rotatably mounted on a first axis;

(b) means for applying ink to the printing die;

(c) an offset roll having an outside circumference which is positioned for rolling contact with the printing die to transfer from the printing die to the outside circumference of the offset roll printed indicia to be transferred to an article which is located at a stationary rest position at a time prior to printing and at a printing position during printing, the offset roll being rotatably mounted on a second axis;

(d) means for continuously rotating the die roll and the offset roll respectively about the first and second axes, the linear velocity of the printing die and the linear velocity of the outside circumference of the offset roll being substantially identical;

(e) an article conveying means for carrying articles to be printed, the article conveying means being stopped prior to the transfer of indicia to each article and moving at a linear velocity which is substantially identical to the linear velocity of the outside circumference of the offset roll during the transfer of indicia from the offset roll to the article to be printed at the printing position;

(f) drive means for moving the article conveying means at said linear velocity; and (g) displacement means for selectively moving the offset roll between first and second positions, the outside circumference of the offset roll being out of contact with the article to be printed when the offset roll is in the first position and the article to be printed is at the rest position and the outside circumference of the offset roll being in rolling contact with the article to be printed when the offset roll is in the second position and the article to be printed is at the printing position.

* * * * *